US006846211B2

(12) United States Patent
Yasuda et al.

(10) Patent No.: US 6,846,211 B2
(45) Date of Patent: Jan. 25, 2005

(54) COVER JOINING STRUCTURE FOR OUTBOARD ENGINE UNIT

(75) Inventors: Toyoshi Yasuda, Wako (JP); Makoto Yazaki, Wako (JP); Shinichi Ide, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/621,473

(22) Filed: Jul. 17, 2003

(65) Prior Publication Data

US 2004/0018785 A1 Jan. 29, 2004

(30) Foreign Application Priority Data

Jul. 18, 2002 (JP) ..... 2002-209643
Jul. 18, 2002 (JP) ..... 2002-210059

(51) Int. Cl.[7] ..... B63H 20/32
(52) U.S. Cl. ..... 440/77
(58) Field of Search ..... 440/76, 77; 123/195 P

(56) References Cited

U.S. PATENT DOCUMENTS 5,360,358 A * 11/1994 Haman ..... 440/77
5,487,687 A * 1/1996 Idzikowski et al. ..... 440/77
6,296,536 B1 * 10/2001 Katayama et al. ..... 440/77

* cited by examiner

*Primary Examiner*—Ed Swinehart
(74) *Attorney, Agent, or Firm*—Adams & Wilks

(57) ABSTRACT

Fixedly joining sections are provided on opposed joining edges of left and right undercover members defining part of an engine space of an outboard engine unit. The opposed joining edges are abutted against each other with the joining sections of the left and right undercover members overlapped in face-to-face relation with each other in a front-and-rear direction of the outboard engine unit. Fasteners, such as bolts, fasten together the overlapped joining sections in the front-and-rear direction, to thereby join together the left and right undercover members. The joining sections may be provided on frame members integrally secured to the respective inner side surfaces of resin-made outer wall sections of the left and right undercover members.

9 Claims, 27 Drawing Sheets

COVER JOINING STRUCTURE FOR OUTBOARD ENGINE UNIT

FIELD OF THE INVENTION

The present invention relates to an improved structure for joining together separate left and right cover members, such as those of an engine cover of an outboard engine unit.

BACKGROUND OF THE INVENTION

Various engine spaces of outboard engine units have been proposed, such as one that comprises a fixed lower casing and an upper covering detachably attached to the fixed lower casing, and one that comprises a lower casing, including a pair of left (port-side) and right (starboard-side) lower cover members, and an upper covering.

One example of the engine spaces is known from Japanese Patent Laid-Open Publication No. SHO-62-18394. In the disclosed engine space, a lower engine cover, which covers a lower section of the engine, is composed of left and right lower cowls that are joined together with their respective edges abutted against each other along a substantially middle portion of the cover, to thereby constitute a lower half section of the engine space.

FIG. 28 hereof schematically shows an example of a structure for joining together the left and right members, along their front and rear edges, of the lower casing 100 in the conventional engine space. Here, the left and right members 101 and 102 have, at their opposed edges 101*a* and 102*a*, joining flanges 103 and 104 extending in parallel outwardly in a front-and-rear direction of the engine space. These flanges 103 and 104 are fastened together by means of a horizontal bolt 105 inserted, in a left-and-right direction of the engine space (i.e., in a direction intersecting abutted surfaces or bearing surfaces of the flanges 103 and 104), through holes 103*a* and 104*a* formed in the flanges 103 and 104 and threadedly engaged with a nut 106. Thus, the left and right members 101 and 102 of the lower casing are firmly secured together as a unit to thereby provide the lower casing 100. As an alternative of the lower casing 100, the bolt 105 and nut 106 may be received in an elongated recessed portion of an appropriate shape formed (kind of scooped), across the opposed edges 101*a* and 102*a* and threadedly engaged with each other, instead of the above-mentioned flanges being formed.

In the conventional engine space, the left and right members, constituting port-side and starboard-side undercover members of the outboard engine unit, have relatively great widths in portions near both of the front and rear ends thereof. Due to such relatively great widths, concave and convex surfaces (projecting and depressed surfaces, i.e. surface unevenness) of the front and rear joining sections would considerably impair the overall outer appearance of the outboard engine unit. Particularly, in the outboard engine unit, such concave and convex surfaces (surface unevenness) tend to be a great block when a large, smooth, continuous surface, such as a flush or even surface, is desired.

Further, in order to reliably prevent water from entering the engine space through between the abutted surfaces of the port-side and starboard-side undercover members when, for example, a following wave is encountered, it is absolutely desirable that the abutted surfaces of the port-side and starboard-side undercover members be secured to each other with maximum tightness.

Generally, the body of the conventional outboard engine units is formed of an aluminum such that the engine of a relatively great weight is mounted on the stern of the boat with sufficient rigidity. Some of the outboard engine units employ resin-made components with a view to reducing the overall weight and costs of the engine unit. In some of the coverings that form the engine space, not only a detachable upper engine cover that defines an upper half section of the engine space but also a lower engine cover that defines a lower half section of the engine space is sometimes formed of resin. In the case where the upper and lower engine covers are formed of resin, it is desirable that an access opening of the engine space, normally formed between the upper and lower engine covers to permit various operations, such as loading, maintenance, etc. of the engine, be as great as possible. In addition, because resin-made components have less rigidity than aluminum-made components, sufficient rigidity is required of the resin-made lower engine cover for supporting thereon the detachable upper engine cover.

One example of such resin-made covers of outboard engine units is disclosed in Japanese Patent Laid-Open Publication No. HEI-6-234393. The HEI-6-234393 publication discloses a resin-made cover having reinforcing ribs to secure necessary rigidity of the cover, and also discloses a technique for avoiding adverse influences of sink marks that would be cased in the resin-made component due to molding of the ribs.

Generally, a fastening structure using bolts or the like is employed to join together resin-made left and right cover members, in which case high rigidity is required of portions of the cover members to be joined. For example, U.S. Pat. No. 4,348,194 proposes a structure for joining together resin-made left and right lower (under) cover members.

According to the technique disclosed in the No. HEI-6-234393 laid-open publication, it is necessary to empirically acquire, through trial and error, appropriate processing that can effectively prevent undesired sink marks from being produced in the reinforcing ribs requiring a relatively great thickness. Acquiring such appropriate processing requires a significant amount of skill and experience, and therefore commercialization of the resin-made cover would require a great amount of time and labor. Further, where the ribs of the resin-made cover members form partition walls of the engine space in conjunction with other components that are to be joined with the covers, the presence of a joining web (denoted by reference numeral 148 in the publication) would create a particular need to allow for a drafting (pulling) direction of a molding die relative to the molding. In addition, the depth of a channel (denoted by reference numeral 188 in the publication), formed along an edge of the cover member, can not be so great in view of a draft angle of the ribs, Consequently, designing freedom or flexibility tends to be considerably limited.

According to the structure for joining resin-made left and right cover members disclosed in U.S. Pat. No. 4,348,194, the left and right cover members are secured together via a bracket by means of two screws. In this case, the cover members have to have sufficient rigidity to remain securely joined together by the screws.

SUMMARY OF THE INVENTION

In view of the foregoing prior art problems, it is an object of the present invention to provide an improved cover joining structure for an outboard engine unit which can reduce surface unevenness around a fastener, such as a bolt, fastening together left and right cover members of an undercover and thereby permits a smooth continuous surface of mutually-joined sections of the cover members and an improved outer appearance.

It is another object of the present invention to provide an improved cover joining structure for an outboard engine unit which allows mutually-joined sections of separate resin-made left and right undercover members to have high rigidity so that the separate left and right undercover members can be joined together with enhanced reliability.

It is still another object of the present invention to provide an improved cover joining structure for an outboard engine unit which permits an enhanced designing freedom, facilitated manufacturing and improved appearance of a resin-made cover.

According to an aspect of the present invention, there is provided a cover joining structure in an outboard engine unit of a type which includes an engine; a propeller drivable by the engine; a drive shaft for transmitting a driving force from the engine to the propeller; a casing assembly supporting thereon the engine and rotatably supporting and accommodating therein the drive shaft, the outboard engine unit being attached via the casing assembly to a body of a boat for tilting and steering movement; and a covering assembly defining at least part of an engine space for accommodating therein the engine, the covering assembly including separate left and right cover members. The cover joining structure of the invention comprises fixedly joining sections provided on respective ones of opposed joining edges of the left and right cover members, the opposed joining edges of the left and right cover members being abutted against each other with the fixedly joining sections of the left and right cover members overlapped in face-to-face relation with each other in a front-and-rear direction of the outboard engine unit; and a fastener for fastening together the overlapped fixedly joining sections in the front-and-rear direction, to thereby join together the left and right cover members.

Namely, in the present invention, the fixedly joining sections are provided on the opposed joining edges of the left and right cover members, the opposed joining edges of the left and right cover members are abutted against each other with the fixedly joining sections of the left and right cover members overlapped in face-to-face relation with each other in the front-and-rear direction of the outboard engine unit, and the fixedly joining sections of the left and right cover members are fastened together by means of the fastener, such as a bolt, in the front-and-rear direction. Because the fastening by the fastener is in the front-and-rear direction of the outboard engine unit, the present invention can eliminate needs for the fastener to be inserted in a left-and-right direction of the outboard engine unit and for any noticeable projecting and/or depressed surface to be formed in the left-and-right direction for receiving the faster as in the prior art outboard engine units. Therefore, it is possible to prevent any noticeable projection and/or depression from being formed around the fastener fastening together the left and right cover members that have gently-curved surfaces. Consequently, the present invention can minimize a degree of projection and/or depression (surface uneveness) around the fastener, and thereby allows the joint between the left and right cover members to have neat, smooth, continuous surfaces. As a result, the present invention achieves a significantly improved outer appearance of the outboard engine unit.

In an embodiment, the left and right cover members are port-side and starboard-side undercover members of an undercover of the covering assembly detachably attached with respect to the body of the boat.

In a preferred implementation, the fixedly joining section provided on one of the left and right cover members has a surface slanted from its proximal end toward its distal end in one of forward and rearward directions while the fixedly joining section provided on the other of the left and right cover members has a surface slanted from its proximal end toward its distal end in the other of the forward and rearward directions at a substantially same value of angle as the slanted surface of the fixedly joining section on the one of the left and right cover members, and the fixedly joining sections of the left and right cover members are overlapped with each other in the front-and-rear direction along the slanted surfaces. In this case, the fixedly joining section provided on the one of the left and right cover members may have an elongated hole extending therethrough in the front-and-rear direction and elongated in the left-and-right direction of the outboard engine unit, and the fastener is loosely inserted through the elongated hole and then threadedly engaged at its distal end portion in a threaded hole formed in the fixedly joining section provided on the other of the left and right cover members.

With the arrangement that the fixedly joining sections of the left and right cover members are overlapped with each other in the front-and-rear direction along the slanted surfaces, the overlapped fixedly joining sections can be laterally brought closer to full overlap (i.e., into a greater degree of overlap) therebetween and pressed against each other more tightly, through "wedge-like" action, as the fastener is tightened. This arrangement permits a secure and reliable joint between the overlapped fixedly joining sections and hence the left and right cover members. Further, with the elongated hole formed in one of the overlapped fixedly joining sections, the overlapped fixedly joining sections can smoothly slide, along the slanted surfaces, relative to each other into a greater degree of overlap, with a simple construction. Thus, smooth and reliable fastening action can be accomplished.

According to another aspect of the present invention, there is provided another improved cover joining structure of the outboard engine unit of the above-mentioned type. The cover joining structure of the invention comprises frame members integrally secured to respective inner side surfaces of resin-made outer wall sections of the left and right cover members; and fixedly joining sections, provided on the respective frame members of the left and right cover members, for joining together the outer wall sections of the left and right cover members.

With the arrangement that the fixedly joining sections are provided on the respective frame members reinforcing the outer wall sections of the left and right cover members, the present invention can secure sufficient rigidity of the outer wall sections. Also, because the fixedly joining sections are provided on such rigid frame members, the separate left and right undercover members can be joined together with high joining rigidity.

With the fixedly joining sections provided on the frame members, the outer wall sections of the cover members can be simple in construction and thus can be formed with ease. Further, because the frame members enhance the rigidity of the corresponding outer wall sections, the present invention can eliminate the sink mark problems of the conventional covering where reinforcing ribs are formed integrally on the cover members, thereby achieving a superior appearance of the covering of the outboard engine unit. Further, with the arrangement that the separate cover members are integrally joined together through the fixedly joining sections provided on the frame members, the outer wall sections of the cover members can be formed with ease into desired construction and shapes, so that the joining edges of the left and right cover members can be joined with an optimal construction and shape without suffering from the sink marks during molding.

Further, because the resin-made frame members are secured to the inner surfaces of the outer wall sections by welding or otherwise, the present invention can eliminate the sink mark problems of the conventional covering during molding of reinforcing ribs, and thus can readily form a covering of superior outer appearance for the outboard engine unit.

In an embodiment, each of the frame members is made of resin. Thus, the resin-made frame members can be readily secured reliably to the resin-made outer wall sections of the corresponding undercover members by vibration welding or other suitable means. Furthermore, because the frame members and outer wall sections are formed of resin, the present invention can achieve reduction in overall weight of the outboard engine unit while assuring enhanced rigidity.

In an embodiment, the cover joining structure further comprises a bolt inserted through the fixedly joining sections, provided on the frame members of the left and right cover members, in the front-and-rear direction, to thereby join together the left and right cover members. Because the left and right undercover members are joined together by the fastening bolt with no noticeable depressed and/or projecting surface formed on the abutted joining edge regions of the cover members, the joint between the cover outer wall sections can have a significantly improved outer appearance. This arrangement can avoid noticeable exposure of the bolt, fixedly joining sections, etc. on the joint between the outer wall sections of the cover members, thereby achieving a good appearance of the joint between the cover members.

In an embodiment, the cover joining structure further comprises a bolt inserted through the fixedly joining sections, provided on the frame members of the left and right cover members, in a vertical direction of the outboard engine unit, to thereby join together the left and right cover members. Because the left and right undercover members are joined together by the fastening bolt with no noticeable depressed and/or projecting surface formed on the abutted edge regions of the cover members, the joint between the cover outer wall sections can have a significantly improved outer appearance. This arrangement too can avoid noticeable exposure of the bolt, fixedly joining sections, etc. on the joint between the outer wall sections of the cover members, thereby achieving a good appearance of the joint between the cover members.

In an embodiment, the cover joining structure further comprises a bolt inserted through the fixedly joining sections, provided on the frame members of the left and right cover members, in a left-and-right direction of the outboard engine unit, to thereby join together the left and right cover members. Because the left and right undercover members are joined together by the fastening bolt with no noticeable depressed and/or projecting surface formed on the abutted edge regions of the cover members, the joint between the cover outer wall sections can have a significantly improved outer appearance. This arrangement too can avoid noticeable exposure of the bolt, fixedly joining sections, etc. on the joint between the outer wall sections of the cover members, thereby achieving a good appearance of the joint between the cover members.

Preferably, in the present invention, each of the fixedly joining sections is provided on a portion of the frame member which is located within the engine space as viewed from above (in a top plan view) and located above a horizontal connection between, i.e. mutually-joined surfaces of, the upper cover and the undercover as viewed sideways (in a side view). Because each of the fixedly joining sections is provided on a portion of the frame member above the mutually-joined surfaces of the upper and undercovers, the bolt can be easily and reliably inserted to fasten together the fixedly joining sections on the opposed frame members. Also, the thus fastened-together joining sections can be effectively concealed by the mutually-joined surfaces of the upper and undercovers, with no noticeable projecting and/or depressed surface, associated with the bolting, exposed on the outer wall sections of the cover members. As a result, the present invention can not only accomplish a superior outer appearance, but also facilitate the joining operations because the fixedly joining sections are located above the mutually-joined surfaces of the upper and undercovers.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Figure 1:
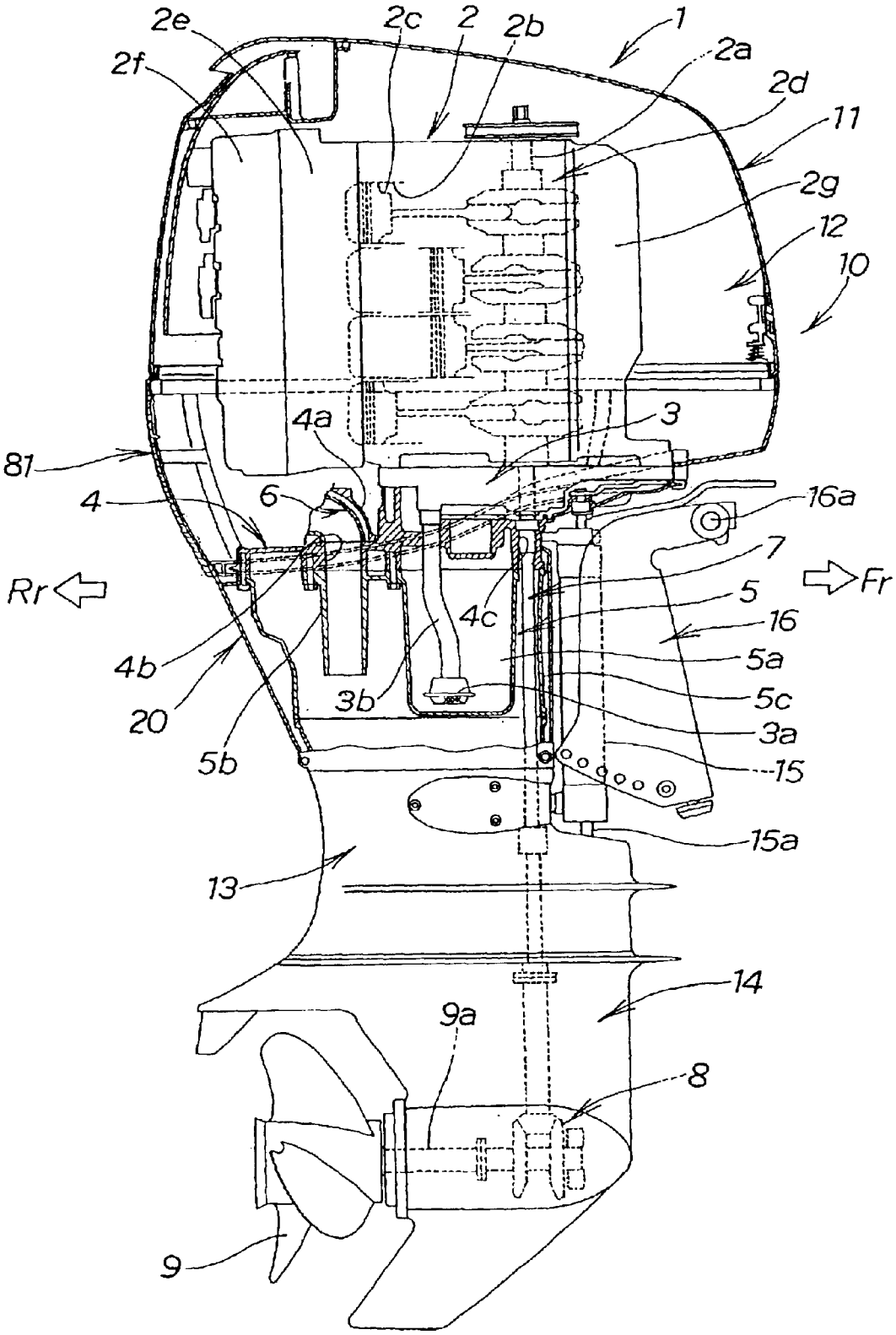
FIG. 1 is a side view showing principal sections of an outboard engine unit, with parts broken away, which employs a cover joining structure in accordance with the present invention.
Figure 2:
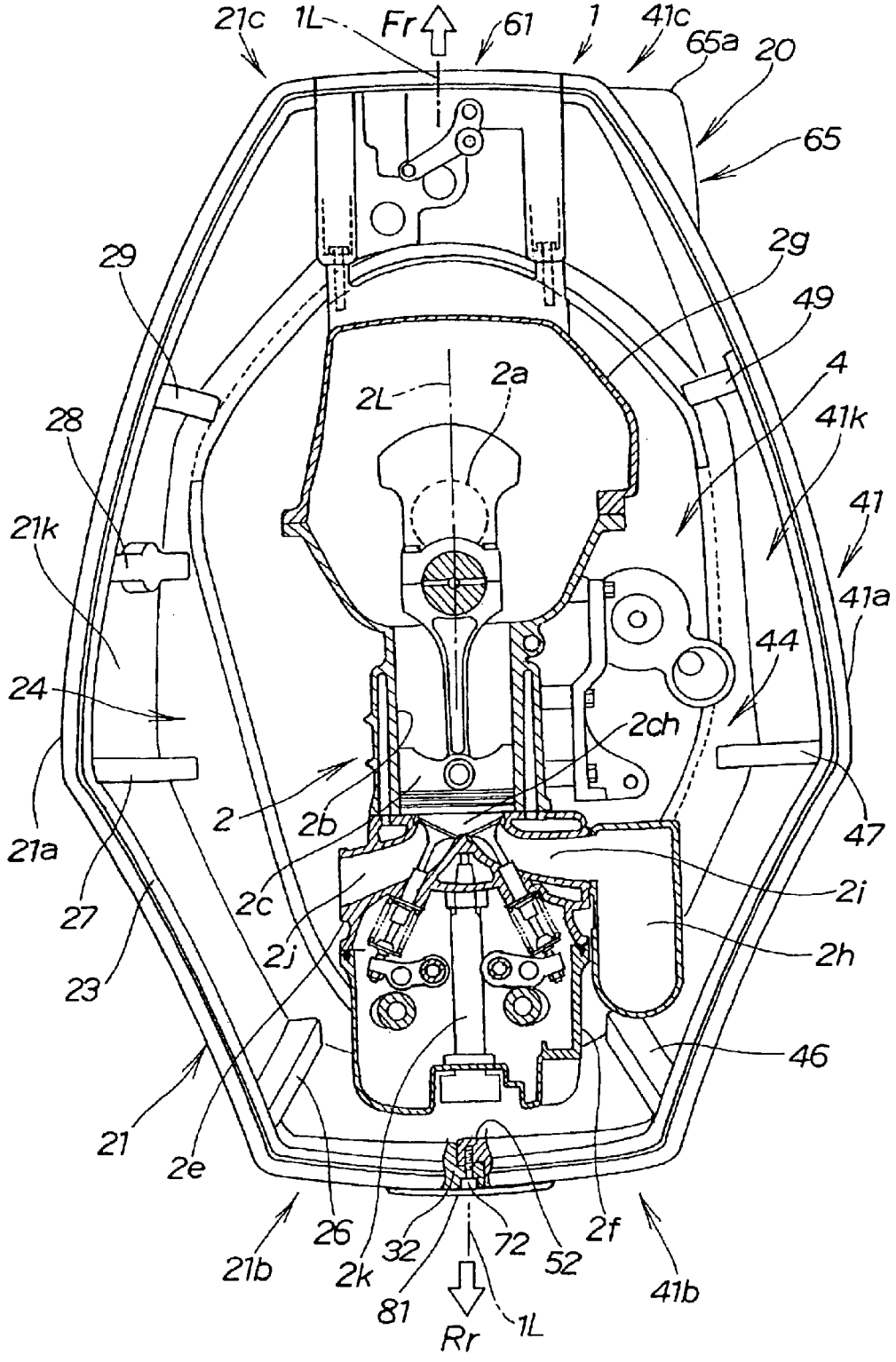
FIG. 2 is a partly sectional top plan view of an undercover and engine with an upper engine cover removed.

Reference is made initially to FIGS. 1 and 2. In these and other Figures, reference character "Fr" represents a forward propelled direction of the boat to which is applied the outboard engine unit of the present invention, while reference character "Rr" represents a rearward direction opposite from the forward propelled direction of the boat.

The outboard engine unit 1 of FIG. 1 comprises a casing assembly that supports thereon the engine 2, and a covering assembly that covers the engine 2 to form an engine space 12.

The engine 2 is a vertical-type engine having a crankshaft 2*a* elongated vertically. The engine 2 includes a plurality of cylinders 2*b*, which are provided in such vertical alignment that their respective horizontal center lines 2L (only one of which is shown in FIG. 2 ) all lie in a substantial middle portion between left and right inner side surfaces of the outboard engine unit and which extend generally in the front-and-rear direction of the outboard engine unit 1. Each of the cylinders 2*b* has a horizontal piston 2*c* fitted therein, and a cylinder block 2*d* is formed by intermediate portions, in the front-and-rear direction, of the cylinders 2*b*.

The engine 2 also includes a cylinder head 2*e* positioned rearwardly of the cylinder block 2*d*, a cylinder head cover 2*f* attached to the rear surface of the cylinder head 2*e*, and a crankcase 2*g* positioned forwardly of the cylinder block 2*d*. Each of the cylinders 2*b* forms a combustion chamber 2*ch* together with the corresponding piston 2*c* and cylinder head 2*e*.

As clearly seen from FIG. 2, the engine 2 is a so-called "double overhead camshaft engine" with left and right air intake valves and driving cam shafts therefor mounted on the cylinder head, and a spark plug 2*k* is dispose substantially centrally in each of the combustion chambers 2*ch*. Specifically, the spark plug 2*k* is mounted in a fastening threaded hole (not shown) formed generally on the horizontal center line 2L, and, normally, attachment/detachment, to/from the above-mentioned fastening threaded hole, of the spark plug 2*k* is performed, generally along the front-and-rear direction, in a substantial middle region of the corresponding combustion chamber 2*ch* between the left and right inner side surfaces of the chamber 2*ch*.

The entire engine 2 is supported on a mount case 4 fixed under the engine 2 via a pump body 3. Oil case 5 is disposed on the underside of the mount case 4 so as to extend downward therefrom. On the mount case 4, there is provided a water jacket 4*a* surrounding an exhaust guide 6 that is secured to the mount 4 and connected with an exhaust manifold 2*h* extending from the cylinder head 2*e*. Further, a downward exhaust passageway 5*b*, provided adjacent to an oil pan 5*a* of the oil case 5, and the exhaust guide 6 are in communication with each other via a communicating hole 4*b* formed in the mount case 4; namely, the downward exhaust passageway 5*b* and the exhaust guide 6 are connected in fluid communication with each other via the communicating hole 4*b*. Strainer 3*a* fixed to the lower end of a sucking-up tube 3*b* extending downward from the pump body 3 is positioned within the oil pan 5*a*.

Thus, exhaust gas is let out from the combustion chambers 2*ch*, via the cylinder head 2*e*, exhaust manifold 2*h*, exhaust guide 6, communicating hole 4*b* of the mount case 4 and exhaust passageway 5*b* of the oil case 5, into an extension case 13 as will be later described.

The vertical crankshaft 2*a* of the engine 2, as a whole, is positioned a little closer to the front end of the outboard engine unit 1 than to the rear end of the unit 1, and the lower end of the vertical crankshaft 2*a* is connected, via a flywheel (not shown), to an engine output shaft that passes vertically through the pump body 3 to connect to the upper end of a vertical drive shaft 7.

The drive shaft 7 is passed, via bearings, through a vertical through-hole 4*c* formed in a fore portion of the mount case 4, and then extends downward between the oil pan 5*a* of the oil case 5 and a front portion of a peripheral wall 5*c* of the oil pan 5*a*. Thus, the drive shaft 7 drives an output shaft 9*a* via a transmission/speed changing mechanism 8. Propeller 9 is connected to the rear end of the output shaft 9*a*, so that the propeller 9 positioned at the lower rear end of the outboard engine unit 1 is driven by the engine. Namely, a propelling force is produced by the engine 2 driving the drive shaft 7 to thereby drive the propeller 9 by way of the transmission/speed changing mechanism 8.

Upper, side peripheral and lower sections of the engine 2 are covered with the covering assembly 10 that forms part of outer panels of the outboard engine unit 1. The covering assembly 10 includes a cap-shaped upper engine cover 11 opening downward to cover an upper end section and a vertically intermediate section of the engine 2, and a generally-cylindrical lower engine cover or undercover 20 covering a lower section of the engine 2, pump body 3, mount case 4 and oil case 5.

The undercover 20 of the covering assembly 10 is a two-piece, or two-part, cover composed of a pair of left and right, i.e. port-side and starboard-side, undercover members 21 and 41 that are joined together in edge to edge relation to each other, as will be later detailed. Note that the port side is a left side of the outboard engine unit 1 as viewed in the propelling direction of the unit while the starboard side is a right side of the unit 1 as viewed in the propelling direction. The upper engine cover 11 and an upper portion of the undercover 20 together constitute the engine space 12 above the mount case 4. The engine space 12 is located in an upper section of the outboard engine unit 1, and the mount case 4 functions as a bottom of the engine space 12.

The extension case 13, typically formed of an aluminum alloy, extends downward from the oil case 5 fixedly joined to the underside of the oil case 5. Gearcase 14 is provided under the extension case 13, and the gearcase 14 accommodates therein a lower portion of the above-mentioned drive shaft 7, transmission/speed changing mechanism 8 and output shaft 9*a*.

Lower section of the undercover 20 extends downward so as to cover the outer periphery of the joint between the mount case 4 and the oil case 5.

Swivel shaft 15*a* is connected between respective fore end portions of the undercover 20 and extension case 13, and a stern bracket 16 is connected to a swivel case 15 via a tilt shaft 16*a*. Via the stern bracket 16, the outboard engine unit 1 is mounted on the stern of the boat for vertical tilting movement and horizontal steering movement.

The above-mentioned mount case 4, oil case 5, extension case 13 and gear case 14 together constitute the casing assembly.

As seen in FIG. 2, the undercover 20 is composed of the port-side and starboard-side undercover members 21 and 41 and these cover members 21 and 41, as viewed in top plan of FIG. 2, form a horizontally symmetrical sectional shape with their respective intermediate portions 21*a* and 41*a* swelling or bulging outwardly away from each other.

As seen from FIGS. 1 and 2, the cover members 21 and 41 of the undercover 20 has upper front end portions 21*c* and 41*c* swelling forwardly and upper rear portions 21*b* and 41*b* swelling rearwardly. Lower section of the undercover 20 has front end surfaces 21*d* and 41*d* slightly curved rearwardly so as not to interfere with the swivel case 15 and stern bracket 16.

The port-side and starboard-side undercover members 21 and 41 are abutted against each other along their vertical edges 21*e* and 41*e*, and the abutted positions of the cover members 21 and 41 generally align with a horizontal center line 1L of the outboard engine unit 1 as viewed in top plan.

In FIG. 2, a lower section of the engine 2 is shown in cross section. As seen from FIG. 3, the upper front end portions 41*c* and 21*c* of the right and left cover member 41 and 21 project forward, from upper ends of front end surfaces 41*d* and 21*d* of lower half sections of the cover members 41 and 21, to form shelf-like projections in front of the crankcase 2*g* of the engine 2. Unlike between rear portions 41*b* and 21*b* of the right and left cover member 41 and 21, a space is formed between the shelf-like upper front end portions 41*c* and 21*c*, so that a cable supporting bracket 61 is fixedly mounted between the upper front end portions 41*c* and 21*c* in front of the crankcase 2*g* of the engine 2.

The cable supporting bracket 61 is formed of an aluminum alloy or the like and has a rear (inner) portion connected to a front portion of the crankcase 2*g*. Details of the cable supporting bracket 61 will be described later.

Exhaust passageway 2*i* of the cylinder head 2*e* is connected to the exhaust manifold 2*h* disposed sideways of the passageway 2*i*. Air intake passageway 2*j*, provided opposite to the exhaust passageway 2*i*, is connected to an air intake manifold (not shown).

Figure 3:
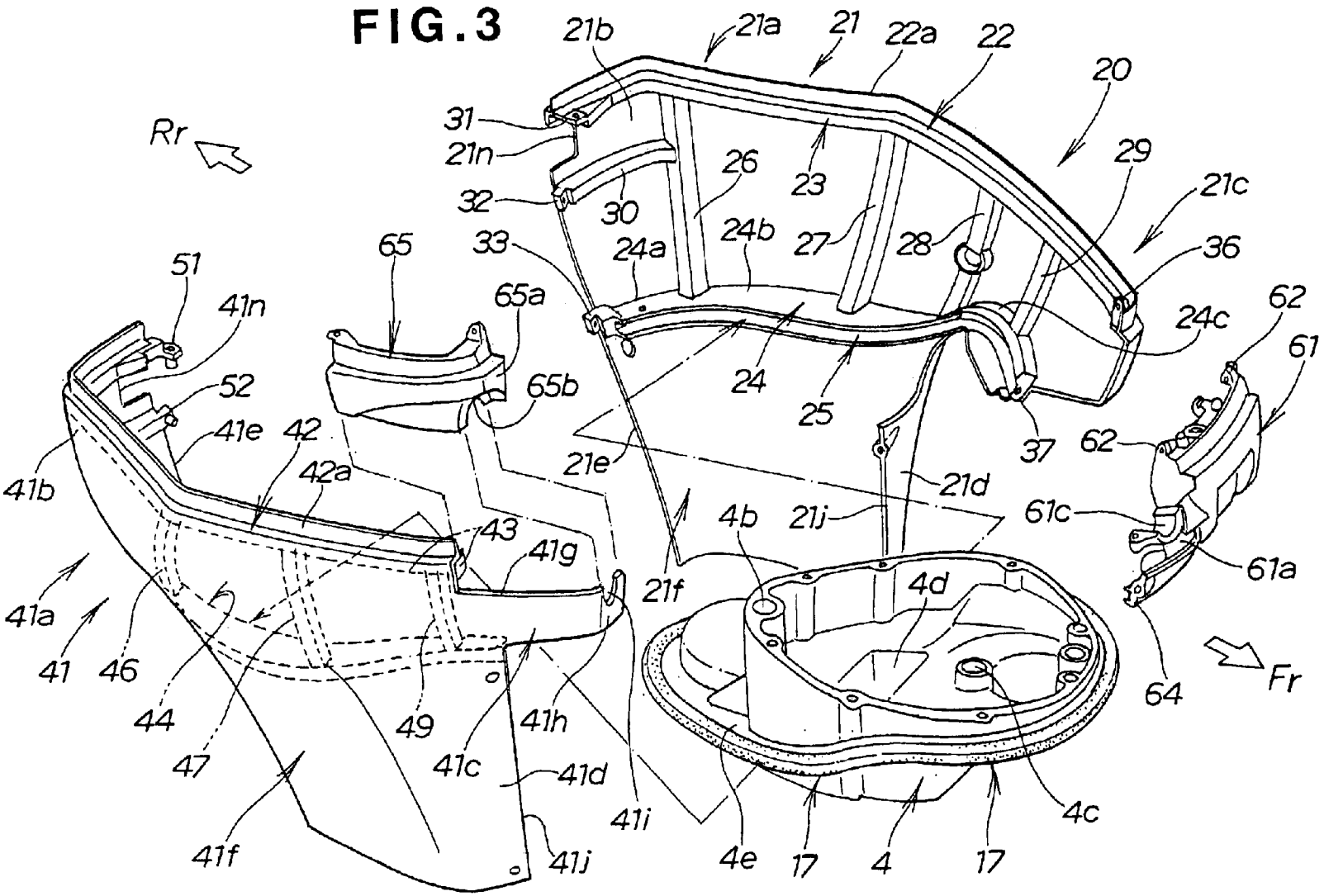
FIG. 3 is an exploded perspective view showing a port-side (left) undercover member, starboard-side (right) undercover member and mount case of the outboard engine unit.
Figure 4:
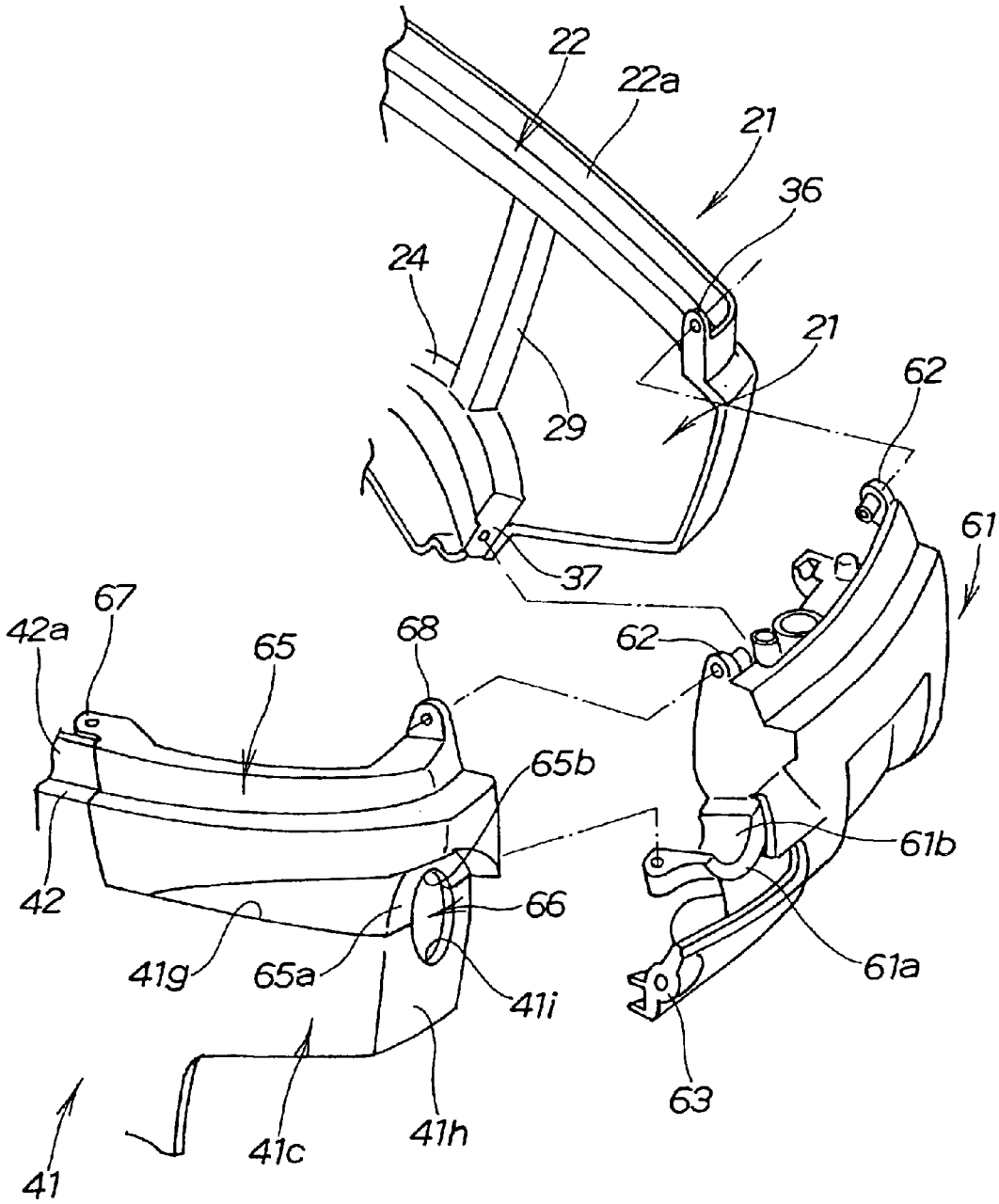
FIG. 4 is an enlarged perspective view showing a principal portion of FIG. 3.

FIG. 3 is an exploded perspective view showing the port-side undercover member 21, starboard-side undercover member 41 and mount case 4. FIG. 4 is an enlarged perspective view showing a principal portion of FIG. 3.

The port-side and starboard-side (i.e., left and right) undercover members 21 and 41 are made of resin, such as glass-fiber-reinforced plastics (e.g., polypropylene).

The rear portion 21*b* or 41*b* of the cover members 21 and 41 have opposed vertical edges 21*e* and 41*e* where the cover members 21 and 41 are abutted against and joined to each other.

Further, a lower half section 21*f* or 41*f* of each of the cover members 21 and 41 has a smaller dimension in the front-and-rear direction than the upper half section. The upper front end portions 21*c* and 41*c* of the left and right cover members 21 and 41 each project forward to provide a shelf-like projection, as mentioned above. The upper front end portion 41*c* of the right cover member 41 has a generally-L-shaped (as viewed sideways) recessed upper region 41*g* so that the upper front end portion 41*c* has a smaller height and at a lower elevation than the upper front end portion 21*c* of the left cover member 21. The recessed upper region 41*g* of the upper front end portion 41*c* has an inwardly-bent front end 41*h* having an upwardly-opening semicircular recess 41*i* formed therein.

As clear from FIG. 1, the front section of each of the left and right undercover members 21 and 41 abruptly bulges forwardly and upwardly, while the rear section of each of the left and right undercover members 21 and 41 gently bulges rearwardly and upwardly. As clear from FIG. 2, the undercover 20 is a two-piece cylinder, composed of the left and right undercover members 21 and 41, having a generally oval cross-sectional shape elongated in the front-and-rear direction. The undercover members 21 and 41 are joined together with the rear vertical edges 21*e* and 41*e* abutted against each other and with front vertical edges 21*j* and 41*j* of the respective lower half sections 21*d* and 41*d* abutted against each other, as will later be described in detail.

Separate cover 65 is fixed on the generally-L-shaped recessed upper region 41*g* of the right undercover member 41 in vertical overlapped relation thereto, and has, at its front end surface 65*a*, a recess 65*b* of a downwardly-opening semicircular shape vertically symmetrical to the above-mentioned recess 41*i* of the right undercover member 41. Thus, the recess 41*i* of the right undercover member 41 and the recess 65*b* of the separate cover 65 together form a circular through-hole, through which a bundle of a throttle cable, shift cable, fuel piping, battery cable, etc. is passed via a grommet (not shown). Connections among the forward projecting end portion 21*c* and 41*c*, separate cover 65 and cable supporting bracket 61 will be detailed later in relation to FIG. 17.

Further, in FIG. 3 showing the mount case 4 in an upper perspective view, the mount case 4 has an opening 4*d* formed in its sealed bottom surface to communicate with the above-mentioned oil pan 5*a*. The mount case 4 has an outer peripheral flange 4*e* that projects outwardly and defines a part of the bottom of the engine space. The flange 4*e* has a front end portion located at a higher elevation than its rear end portion with its intermediate portion slanted downwardly toward the rear end portion.

The mount case 4 also has an annular sealing member 17 secured to the entire outer periphery of the flange 4*e*. The mount case 4 is attached to the inner surface of the undercover 20 by resiliently abutting or fitting the sealing member 17, secured to the entire outer periphery of the flange 4*e*, against or into channel portions 25 of lower horizontal reinforcing frame members 44 and 24 of the right and left undercover members 41 and 21, as will be later detailed. In this way, the mount case 4 is resiliently held, along its outer periphery, by the channel portions 25 of the lower horizontal reinforcing frame members 44 and 24; the sealing member 17 allows the mount case 4 to be secured to the undercover 20 in a fluid-tight manner.

In the above-described manner, the engine space 12 is partitioned by the peripheral flange 4*e* of the mount case 4 and some of the reinforcing frame members secured to the inner surface of the undercover members 21 and 41 engaging with the flange 4*e*.

Figure 5:
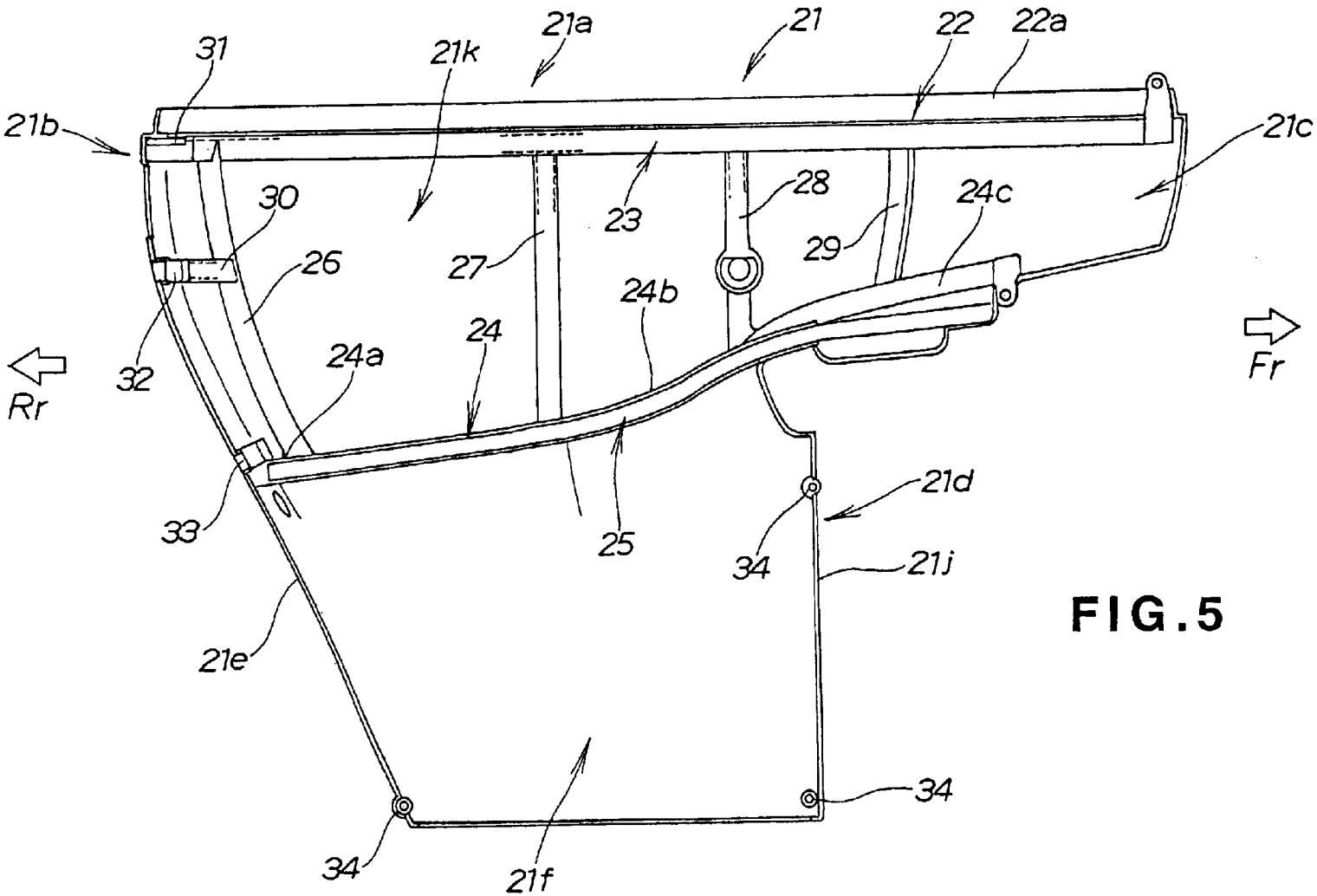
FIG. 5 is a side view showing an inner side of the left undercover member.
Figure 6:
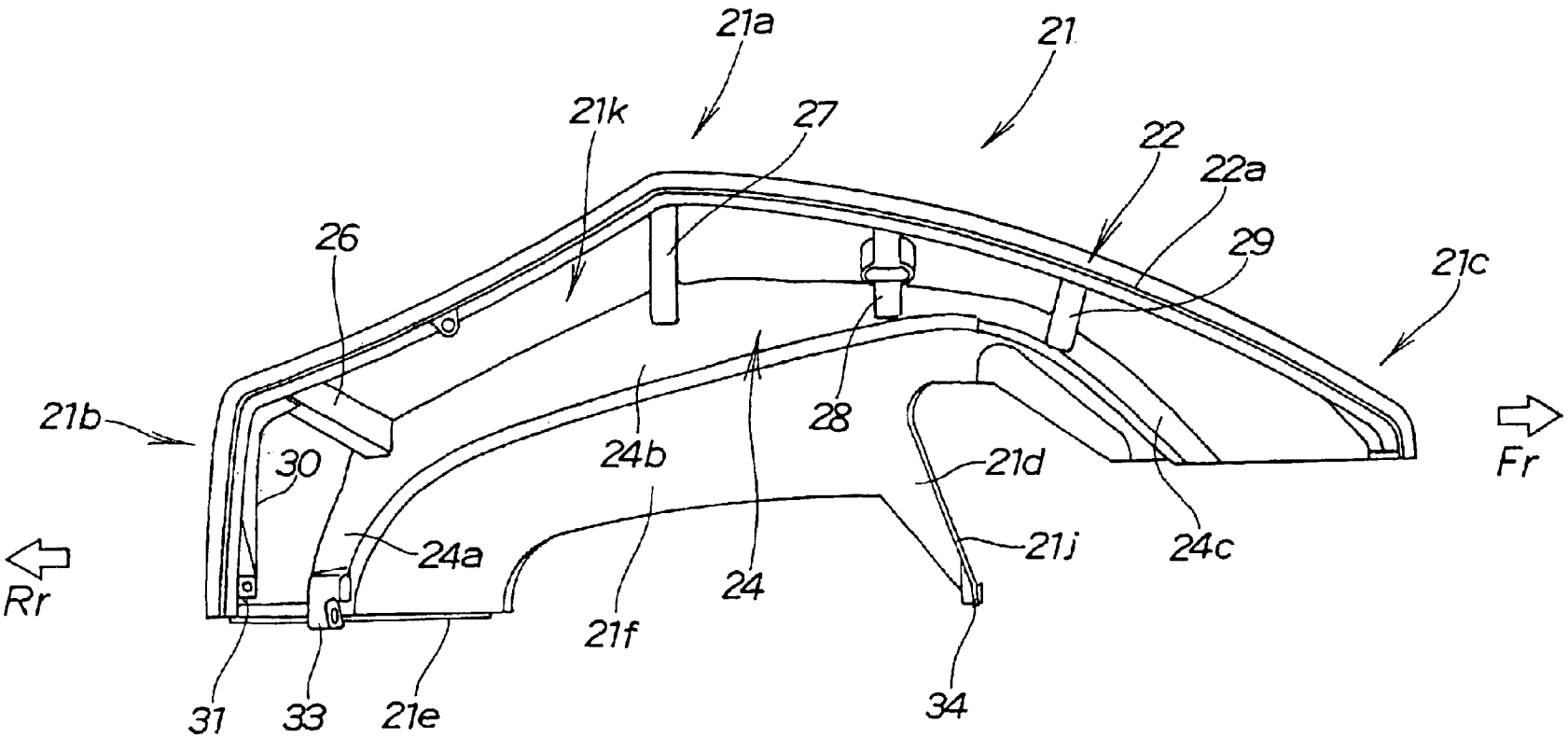
FIG. 6 is a top plan view of the left undercover member.
Figure 7:
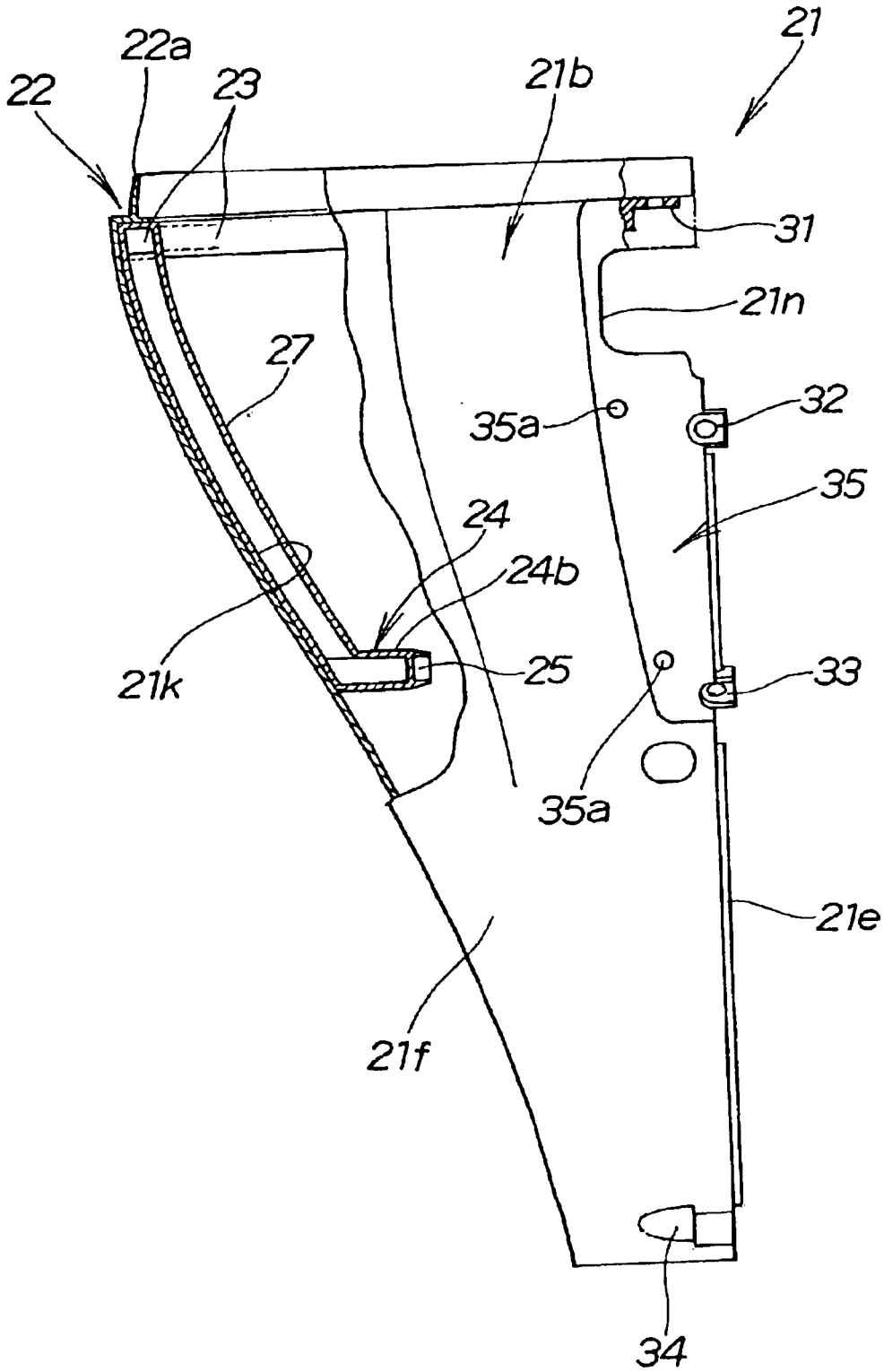
FIG. 7 is a partly-broken away rear end view of the left undercover member.

Now, with reference to FIGS. 3 and 5–7, a more detailed description will be made about the port-side or left undercover member 21. FIG. 5 is an inner side view of the left undercover member 21, FIG. 6 is a top plan view of the cover member 21, and FIG. 7 is a partially-broken-away rear end view of the cover member 21.

The left undercover member 21 of the undercover 20 has an upper end horizontal flange 22 of a small width abutted, via a sealing member, against the lower end edge of the upper engine cover 11, and the upper end horizontal flange 22 extends over a substantially full length, in the front-and-rear direction, of the cover member 21. Vertical flange 22*a* is formed integrally with a widthwise central portion of the horizontal flange 22 to extend along the length of the flange 22 and projects upright from the horizontal flange 22, as clearly seen from FIGS. 3 and 7. The left undercover member 21 includes an upper horizontal reinforcing frame member 23, which is generally straight in shape and secured to the inner side surface 21*k* of the cover member 21 over a substantially full length thereof.

The left undercover member 21 has also a lower horizontal reinforcing frame member 24, which is integrally secured to a vertically middle portion of the inner side surface 21*k* and extending along the above-mentioned upper horizontal reinforcing frame member 23. The lower horizontal reinforcing frame member 24 has a front end portion 24*c* located at a higher elevation than its rear end portion 24*a* with its intermediate portion 24*b* gently slanted downwardly toward the rear end portion 24*a*. The intermediate portion 24*b* of the frame member 24 has a greater width and projects more inwardly than the front and rear end portions 24*c* and 24*a*.

The lower horizontal reinforcing frame member 24 has the inwardly-opening channel portion 25, which abuts against or engages with the above-mentioned sealing member 17 secured to the outer peripheral flange 4*e* of the mount case 4.

As seen in FIG. 5, the left undercover member 21 also has a rear vertical reinforcing frame member 26, rear-intermediate vertical reinforcing frame member 27, front-intermediate vertical reinforcing frame member 28 and front vertical reinforcing frame member 29, which are integrally secured to the inner side surface 21*k* and also secured at their respective upper and lower ends to the upper and lower horizontal reinforcing frame members 23 and 24 to connect between the frame members 23 and 24. In the instant embodiment, all or at least one of the vertical reinforcing frame members 26, 27, 28 and 29 may be integrally formed with the horizontal reinforcing frame members 23 and 24.

Further, in the left undercover member 21, a relatively short subsidiary horizontal reinforcing frame member (intermediate horizontal reinforcing frame member) 30 extends from a vertically middle portion of the rear vertical reinforcing frame member 26 to the inner surface of the rear end portion 21*b*.

These reinforcing frame members 23, 24 and 26–30 of the left undercover member 21 are each formed, of a material, such as polypropylene, more flexible and softer than that of the above-mentioned cover 21, into a rectangular sectional shape; thus, the reinforcing frame members 23, 24 and 26–30 can be formed into respective desired shapes with ease but can have a great overall mechanical strength.

Although the reinforcing frame members are typically secured to the inner side surface 21*k* of the left undercover member 21 by vibration welding, they may be secured to the inner side surface 21*k* by adhesion or other suitable means.

As seen in FIG. 5, fixedly joining sections 31, 32 and 33 are formed on the rear ends of the above-mentioned horizontal reinforcing frame members 23, 30 and 24, respectively, in vertically spaced-apart relation to one another. The fixedly joining sections 32 and 33 formed on the intermediate horizontal reinforcing frame member 30 and lower horizontal reinforcing frame member 24 are constructed to join the left and right undercover members 21 and 41 via bolts inserted in the front-and-rear direction, as will be detailed later. Further joining sections 34 are provided at front and rear end portions of the lower half section 21*f* of the cover member 21.

As seen in FIG. 7, the left undercover member 21 has a recess 21*n* that is formed in a vertically-elongated upper bearing surface 35 of the rear end portion 21*b* along an upper end region of the vertical edge 21*e* and opens laterally toward the vertical edge 41*e* of the right undercover member 41. The upper bearing surface 35 has upper and lower mounting holes 35*a* for mounting a sealing lid to be described later.

Figure 8:
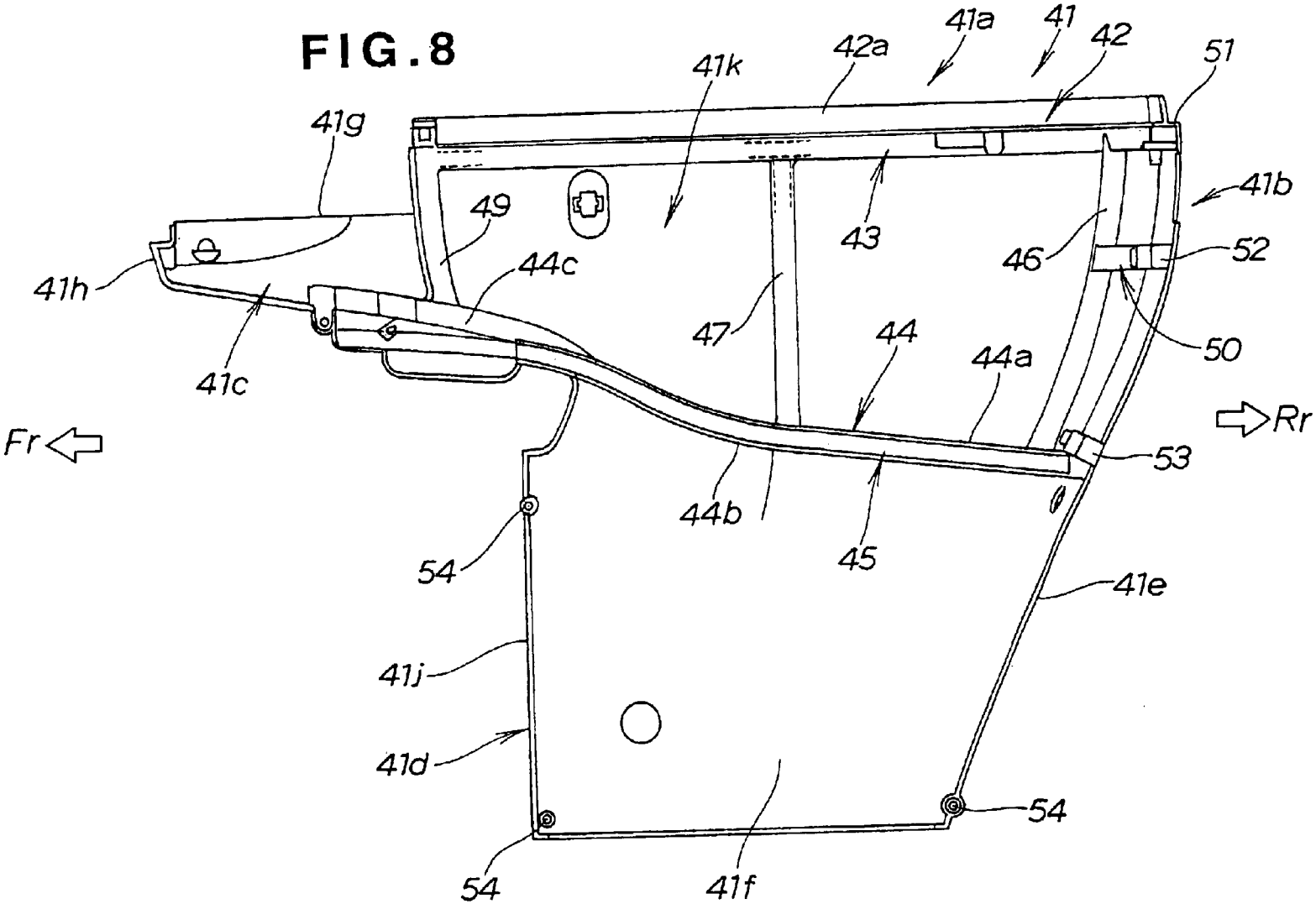
FIG. 8 is a side view showing an inner side of the right undercover member.
Figure 9:
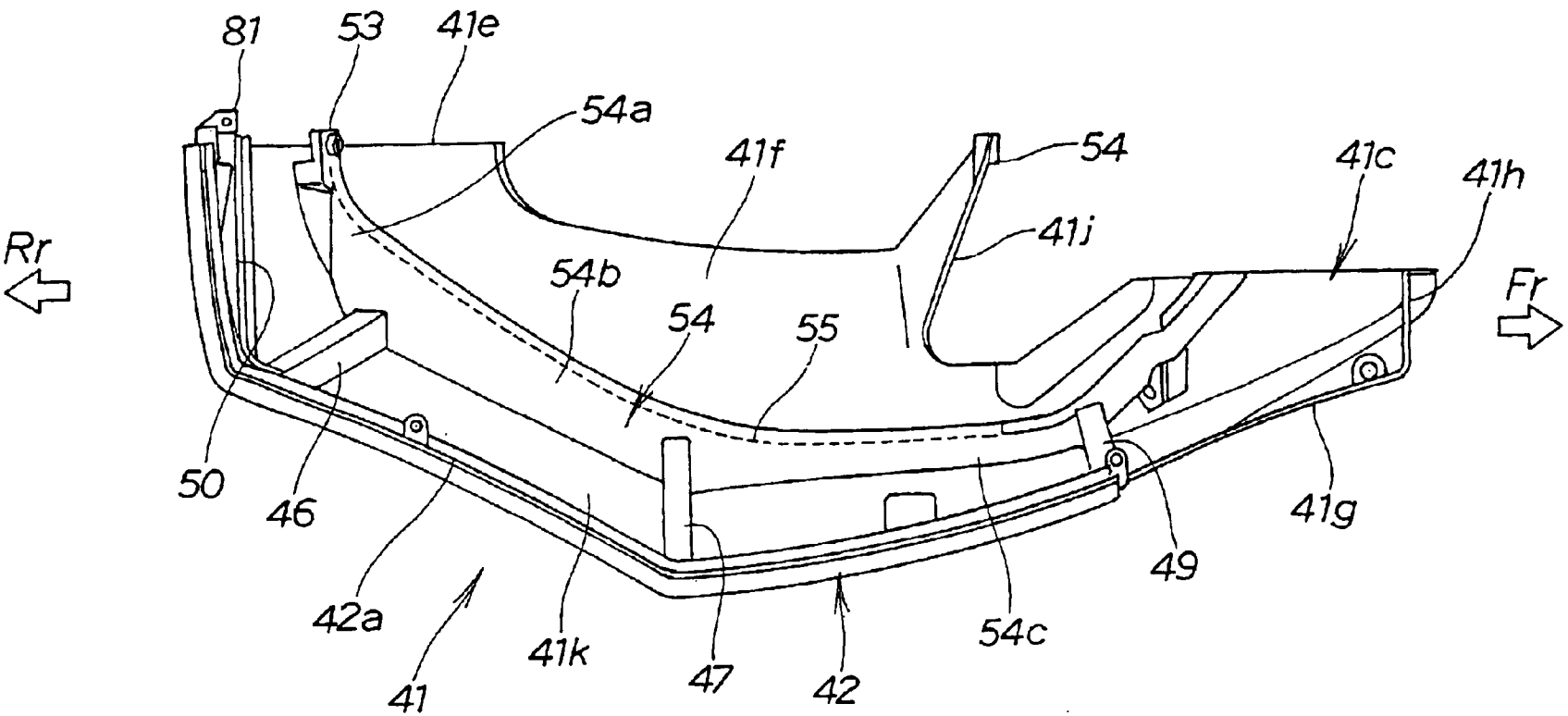
FIG. 9 is a top plan view of the right undercover member.
Figure 10:
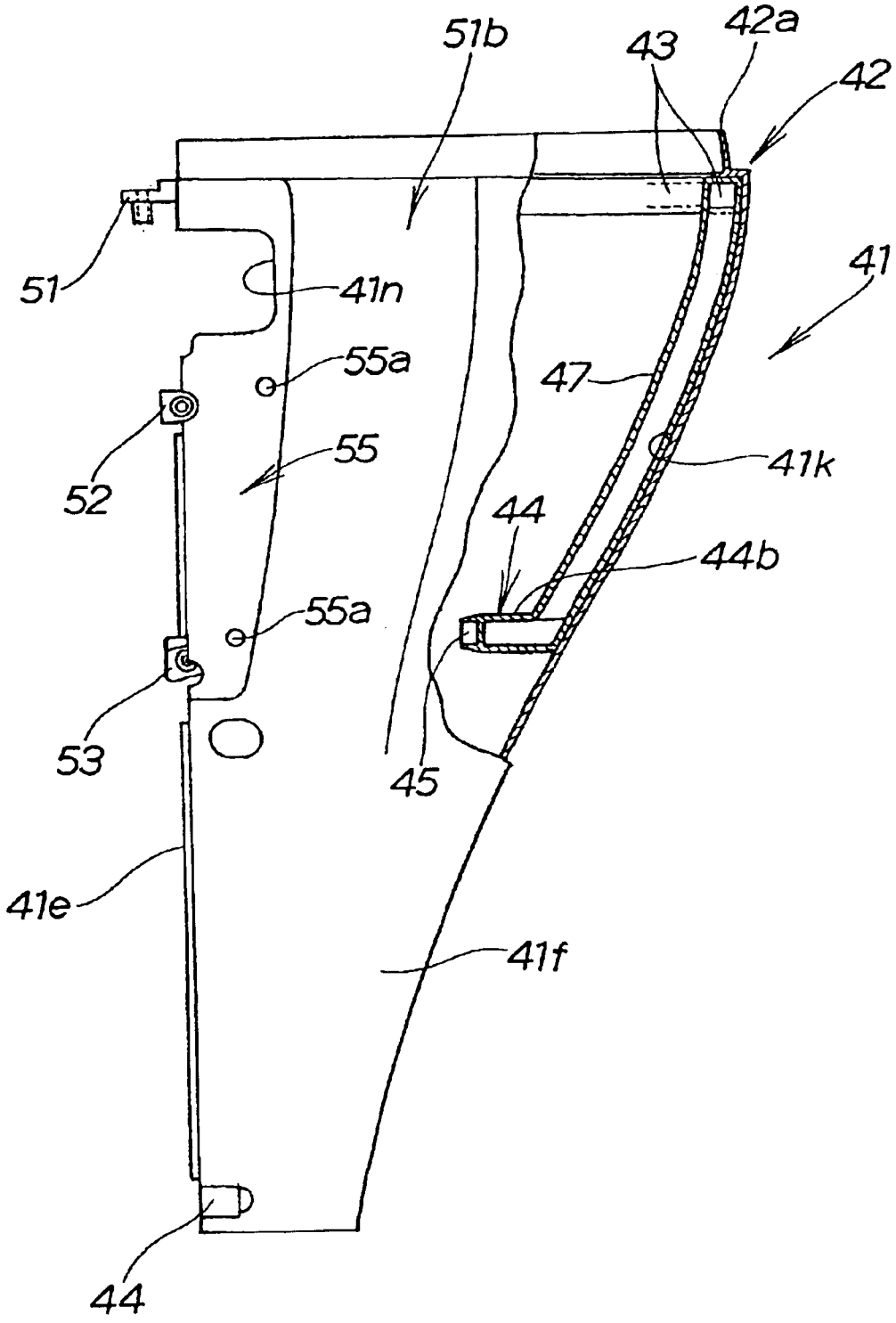
FIG. 10 is a partly-broken away rear end view of the right undercover member.

Next, a more detailed description will be given below about the starboard-side or right undercover member 41, with reference to FIGS. 8, 9 and 10. FIG. 8 is an inner side view of the right undercover member 41, FIG. 9 is a top plan view of the cover member 41, and FIG. 10 is a partially-broken-away rear end view of the cover member 41.

The right undercover member 41 of the undercover 20 has an upper end horizontal flange 42 of a small width abutted, via a sealing member, against the lower end edge of the upper engine cover 11, and the upper end horizontal flange 42 extends over a substantially full length, in the front-and-rear direction, of the cover member 41. Vertical flange 42*a* is formed integrally with a widthwise central portion of the horizontal flange 42 to extend along the length of the flange 42 and projects upright from the horizontal flange 42, as clearly seen from FIGS. 3 and 10. The right undercover member 41 includes an upper horizontal reinforcing frame member 43, which is generally straight in shape and secured to the inner side surface 41*k* of the cover member 41 over a substantially full length thereof.

The right undercover member 41 has also a lower horizontal reinforcing frame member 44, which is integrally secured to a vertically middle portion of the inner side surface 41*k* and extending along the above-mentioned upper horizontal reinforcing frame member 43. The lower horizontal reinforcing frame member 44 has a front end portion 44*c* located at a higher elevation than its rear end portion 44*a* with its intermediate portion 44*b* gently slanted downwardly toward the rear end portion 44*a*. The intermediate portion 44*b* of the frame member 44 has a greater width and projects more inwardly than the front and rear end portions 44*c* and 44*a*.

The lower horizontal reinforcing frame member 44 has an inwardly-opening channel portion 45, which abuts against or engages with the above-mentioned sealing member 17 secured to the outer peripheral flange 4*e* of the mount case 4.

As seen in FIG. 8, the right undercover member 41 also has a rear vertical reinforcing frame member 46, intermediate vertical reinforcing frame member 47 and front vertical reinforcing frame member 49, which are integrally secured to the inner side surface 41*k* and also secured at their respective upper and lower ends to the upper and lower horizontal reinforcing frame members 43 and 44.

Further, in the right undercover member 41, a relatively short subsidiary horizontal reinforcing frame member (intermediate horizontal reinforcing frame member) 50 extends from a vertically middle portion of the rear vertical reinforcing frame member 46 to the inner surface portion of the rear end portion 41*b*.

These reinforcing frame members 43, 44 and 46–50 are each formed, of a material, such as polypropylene, more flexible and softer than that of the above-mentioned cover 41, into a rectangular sectional shape; thus, the reinforcing frame members 43, 44 and 46–50 can be formed into respective desired shapes with ease but can have a great overall mechanical strength.

Although the reinforcing frame members 43, 44 and 46–50 are typically secured to the inner side surface 41*k* of the right undercover member 41 by vibration welding, they may be secured to the inner side surface 41*k* by adhesion or other suitable means.

As seen in FIG. 8, fixedly joining sections 51, 52 and 53 are formed on the rear ends of the above-mentioned horizontal reinforcing frame members 43, 50 and 44, respectively, in vertically spaced-apart relation to one another. The fixedly joining sections 52 and 53 formed on the intermediate horizontal reinforcing frame member 50 and lower horizontal reinforcing frame member 44 are constructed to join the left and right undercover members 21 and 41 via bolts inserted in the front-and-rear direction, as will be detailed later. Further joining sections 54 are provided at front and rear end portions of the lower half section 41*f* of the cover member 41.

As seen in FIG. 10, the right undercover member 41 has a recess 41*n* that is formed in a vertically-elongated upper bearing surface 55 of the rear end portion 41*b* along an upper end region of the vertical edge 41*e* and opens laterally toward the vertical edge 21*e* of the left undercover member 21. The upper bearing surface 55 has upper and lower mounting holes 55*a* for mounting the sealing lid to be described later.

Figure 11:
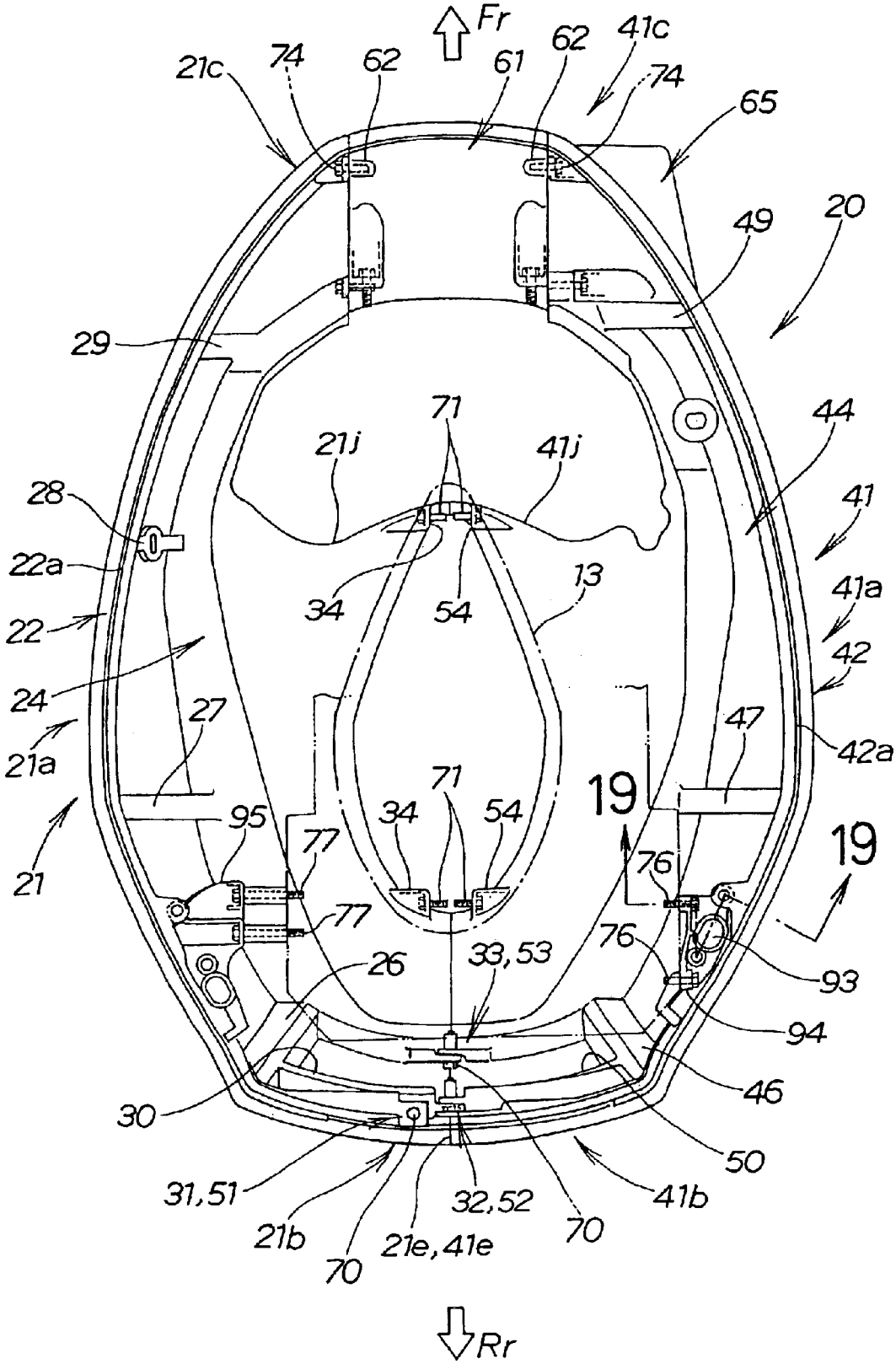
FIG. 11 is a top plan view of the undercover having the left and right undercover members joined to each other at fixedly joining sections.

FIG. 11 is a top plan view of the undercover 20, which has the left and right undercover members 21 and 41 joined to each other through the above-mentioned fixedly joining sections.

Specifically, the left and right undercover members 21 and 41 are joined together to provide the undercover 20, with the vertical edges 21*e* and 41*e* of the rear end portions 21*b* and 41*b* abutted against each other and with the corresponding fixedly joining sections 31–33 and 51–53 overlapped and bolted together in the vertical or front-and-rear direction.

The cable supporting bracket 61 is disposed between and secured, via bolts 70, to the upper front end portions 21*c* and 41*c* of the left and right undercover members 21 and 41, as will be later described. The lower half portions 21*f* and 41*f* of the left and right undercover members 21 and 41 are fastened to an upper end portion of the underlying extension case 13 (denoted by a dot-and-dash line in FIG. 11) by means of horizontal bolts 71 inserted, in the left-and-right (widthwise) direction of the unit 1, through the front and rear joining sections 34 and 54.

Figure 12:
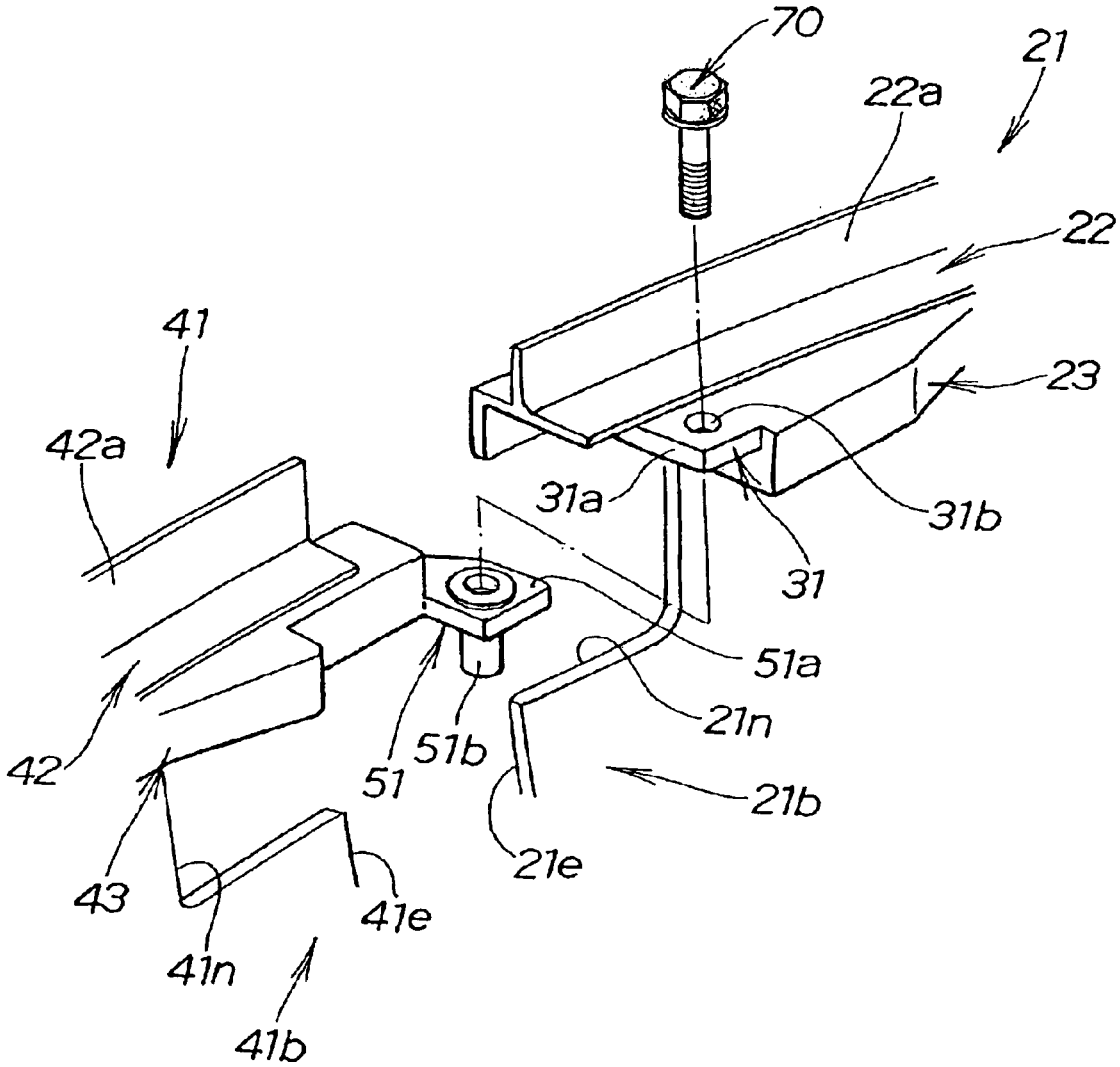
FIG. 12 is an exploded perspective view of a rear cover joining structure before the upper fixedly joining sections are fastened together.
Figure 13:
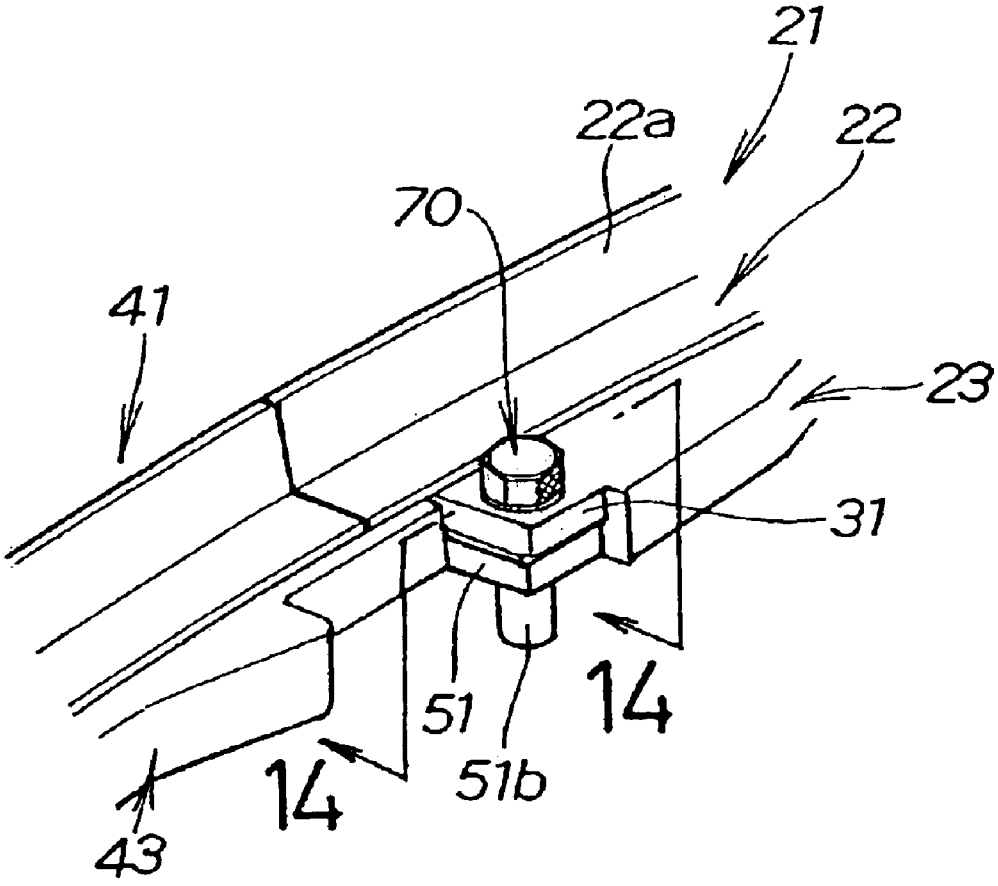
FIG. 13 is a perspective view of the rear cover joining structure after the upper fixedly joining sections are fastened together.
Figure 14A:
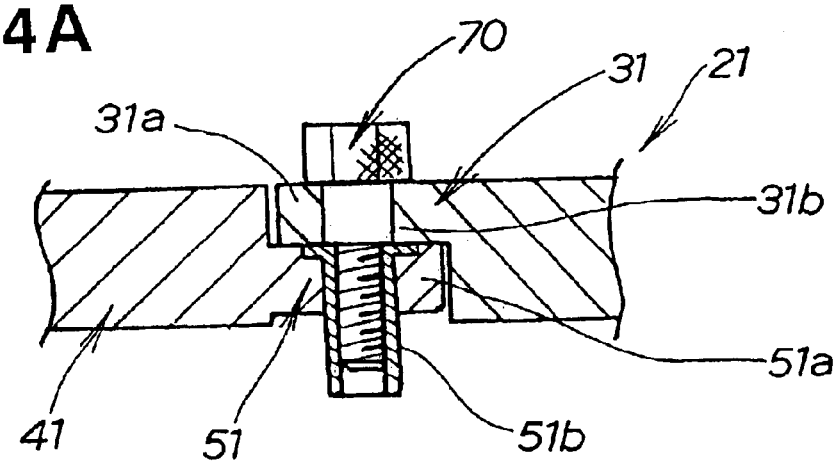
FIG. 14A is a sectional view taken along line 14—14 of FIG. 13, and FIGS. 14B and 14C are enlarged sectional views showing other embodiments of the rear cover joining structure.
Figure 14B:
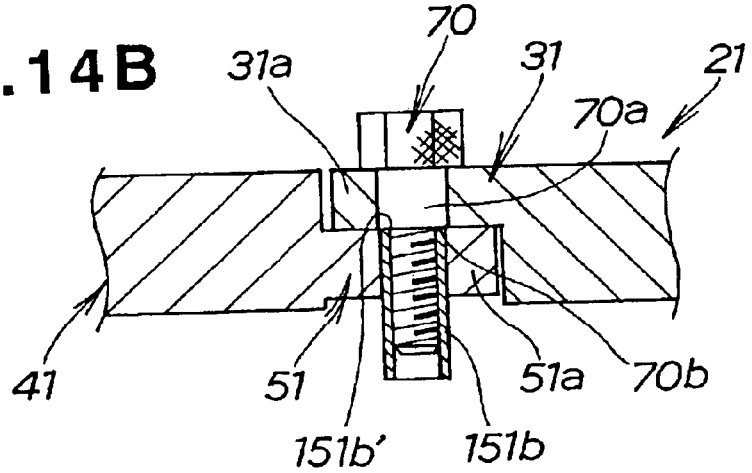
Figure 14C:
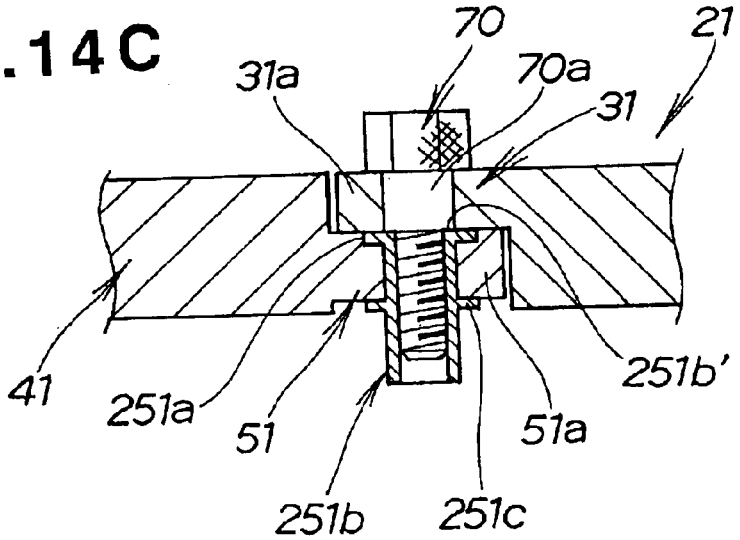

FIGS. 12, 13 and 14A–14C show embodiments of an upper rear joining mechanism that is composed of the upper (uppermost) fixedly joining sections 31 and 51 provided at the rear vertical edges 21*e* and 41*e* of the left and right undercover members 21 and 41. FIG. 12 is an exploded perspective view of the upper rear joining mechanism before the fixedly joining sections 31 and 51 are fastened together, and FIG. 13 is a perspective view of the upper rear joining mechanism after the fixedly joining sections 31 and 51 are fastened together. Further, FIG. 14A is a sectional view taken along line 14—14 of FIG. 13, and FIGS. 14B and 14C show other embodiments of the upper rear joining mechanism.

As clearly seen in FIG. 12, the upper fixedly joining sections 31 and 51 each has a shelf-like piece 31*a* or 51*a*. One of the shelf-like pieces (31*a* in the illustrated example) has a vertical mounting through-hole 31*b*, while the other shelf-like piece (51*a* in the illustrated example) has a cylindrical nut 51*b* vertically embedded therein.

The shelf-like pieces 31*a* and 51*a* are overlapped in the vertical direction, and the bolt 70 is threadedly inserted, through the mounting through-hole 31*b*, into the nut 51*b* to thereby securely fasten together the joining sections 31 and 51. The joining sections 31 and 51 having been thus fastened together are shown in FIG. 13 and FIG. 14A.

FIG. 14B shows another embodiment of the upper rear joining mechanism composed of the upper fixedly joining sections 31 and 51, where the same elements as in FIG. 14A are denoted by the same reference numerals and will not be described to avoid unnecessary duplication.

The embodiment of FIG. 14B is similar to the embodiment of FIGS. 12–14A in that the joining sections 31 and 51 are overlapped and bolted together in the vertical direction, but different therefrom in that a cylindrical nut 151*b* with no upper end flange is fixedly inserted in the shelf-like piece 51*a* of the lower joining section 51 and in that the upper end 151*b*' of the nut 151*b* is abutted against the lower end of a large-diameter neck portion 70*a* of the stepped bolt 70 threadedly engaging with the nut 151*b* so as to prevent a deformation or collapse of the resin-made joining section 51.

FIG. 14C shows still another embodiment of the upper rear joining mechanism composed of the upper fixedly joining sections 31 and 51, where the same elements as in FIG. 14A are denoted by the same reference numerals and will not be described.

In the embodiment of FIG. 14C, a nut 251*b* with upper and lower flanges 251*a* and 251*c* is secured to the shelf-like piece 51*a* of the underlying joining section 51 in such a manner that the shelf-like piece 51*a* is held firmly between the upper and lower flanges 251*a* and 251*c*. The upper flange 251*a* has an upper surface substantially flush with an upper surface of the shelf-like piece 51*a*, and the upper end 251*b*' of the nut 251*b* is abutted against the lower end of a large-diameter neck portion 70*a* of the stepped bolt 70 threadedly engaging with the nut 251*b* so as to prevent a deformation or collapse of the resin-made joining section 51.

Figures 15A, 15B, 15C:
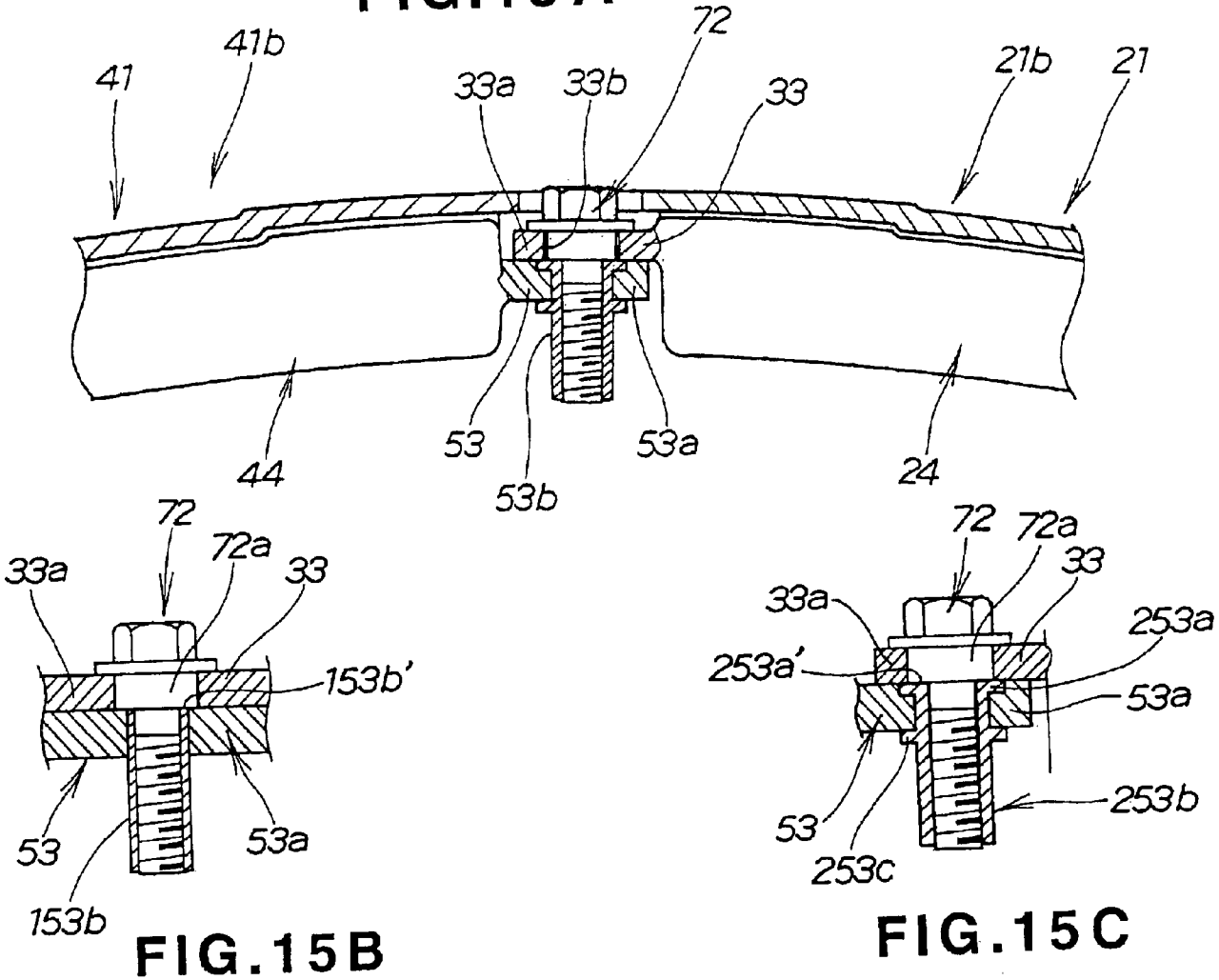
FIGS. 15A to 15C are cross-sectional top plan views showing embodiments of the rear cover joining structure composed of the lower fixedly joining sections of the left and right undercover members.

FIGS. 15A–15C are cross-sectional top plan views showing three embodiments of a lower rear joining mechanism that is composed of the lower (lowest) fixedly joining sections 33 and 53 provided at the rear vertical edges 21*e* and 41*e* of the left and right undercover members 21 and 41.

As illustrated in FIG. 15A, the lower fixedly joining sections 33 and 53 are provided at the rear ends of the lower horizontal frame members 24 and 44 to project beyond the rear vertical edges 21*e* and 41*e*. The joining sections 33 and 53 each include a protrusion 33*a* or 53*a* having a vertical surface. One of the protrusions (33*a* in the illustrated example) has a mounting through-hole 33*b* formed in the front-and-rear direction, while the other protrusion (53*a* in the illustrated example) has a cylindrical nut 53*b* embedded therein so that the axis of the nut 53*b* lies in the front-and-rear direction.

The protrusions 33*a* and 53*a* are overlapped in the front-and-rear direction, and a bolt 72 is threadedly inserted, through the mounting through-hole 33*b*, into the nut 53*b* to thereby securely fasten together the joining sections 33 and 53.

FIG. 15B shows another embodiment of the lower rear joining mechanism composed of the lower fixedly joining sections 33 and 53, where the same elements as in FIG. 15A are denoted by the same reference numerals and will not be described to avoid unnecessary duplication.

The embodiment of FIG. 15B is similar to the embodiment of FIG. 15A in that the joining sections 33 and 53 are overlapped and bolted together in the front-and-rear direction, but different therefrom in that a cylindrical nut 153*b* with no upper end flange is fixedly inserted in the protrusion 53*a* of the lower joining section 53 and in that the upper end 153*b*' of the nut 153*b* is abutted against the lower end of a large-diameter neck portion 72*a* of the stepped bolt 72 threadedly engaging with the nut 153*b* so as to prevent a deformation or collapse of the resin-made joining section 53.

FIG. 15C shows still another embodiment of the lower rear joining mechanism composed of the lower fixedly joining sections 33 and 53, where the same elements as in FIG. 15A are denoted by the same reference numerals and will not be described.

In the embodiment of FIG. 15C, a nut 253*b* with upper and lower flanges 253*a* and 253*c* is secured to the protrusion 53*a* of the lower joining section 53 in such a manner that the protrusion 53*a* is held firmly between the upper and lower flanges 253*a* and 253*c*. The upper flange 253*a* has an upper surface substantially flush with an upper surface of the protrusion 53*a*, and the upper end 253*b*' of the nut 253*b* is abutted against the lower end of a large-diameter neck portion 72*a* of the stepped bolt 72 threadedly engaging with the nut 253*b* so as to prevent a deformation or collapse of the resin-made joining section 53.

The intermediate fixedly joining sections 32 and 52 located between the upper and lower fixedly joining sections 31, 51 and 33, 53 are bolted together in the front-and-rear direction. Namely, these intermediate fixedly joining sections 32 and 52 are fastened together to fixedly join the rear vertical edges 21*e* and 41*e* in the same manner as the lower fixedly joining sections 33 and 53 having been described above in relation to FIG. 15.

Figure 16:
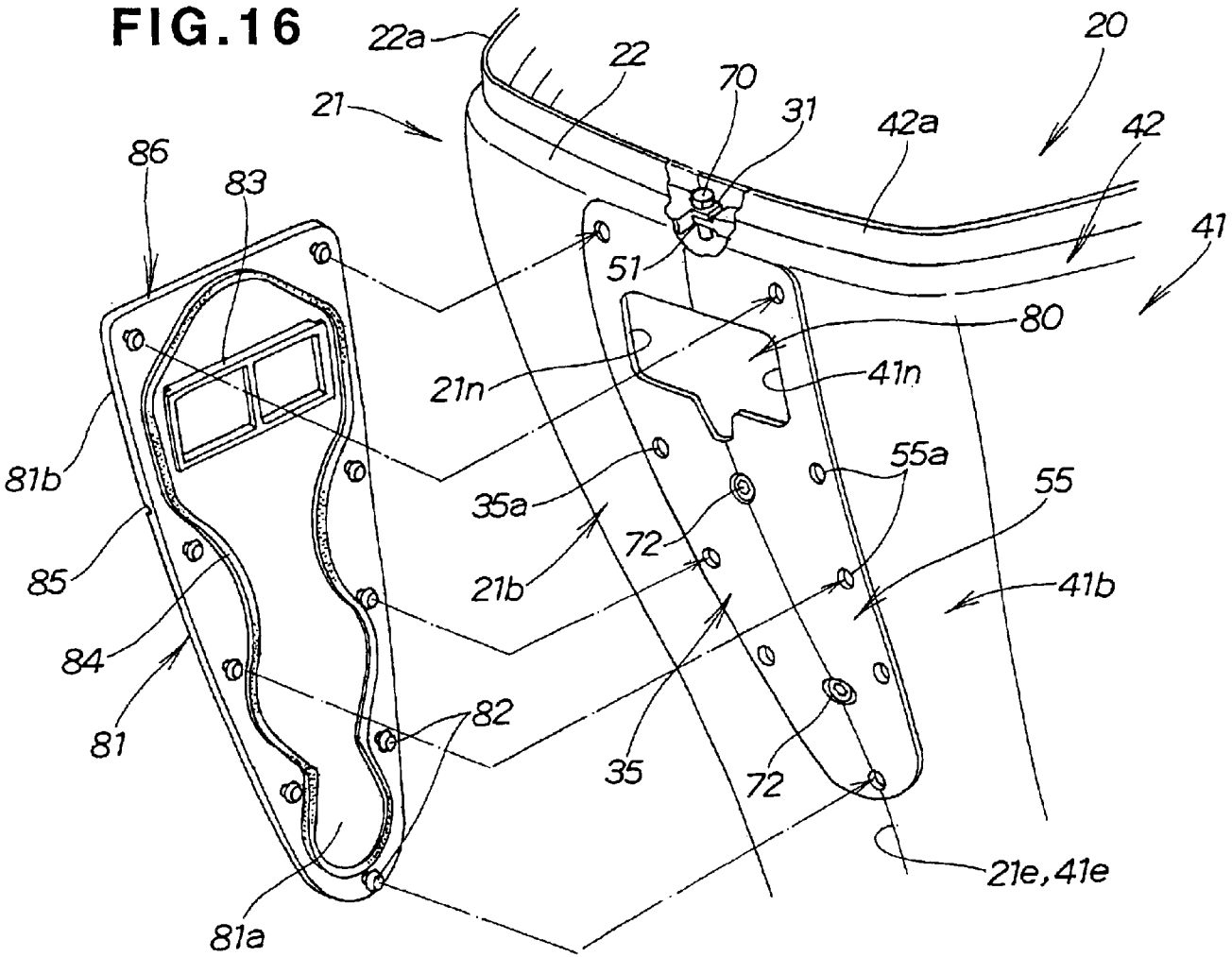
FIG. 16 is an exploded perspective view of a rear end section of the undercover explanatory of how a lid is mounted on the rear end section.

FIG. 16 is an exploded perspective view of the rear end section of the undercover 20 explanatory of how the lid 81 is mounted on the rear end portion.

When the left and right undercover members 21 and 41 are in a joined-together state as shown in the figure, the above-mentioned recesses 21*n* and 41*n* formed in the cover members 21 and 41 together form the rectangular maintenance access opening 80 elongated in the left-and-right (widthwise) direction of the outboard engine unit 1. When the opening 80 is open as shown, any necessary tools can be inserted through the opening 80 into a lower rear interior of the engine space 12 defined by the undercover 20, to perform desired maintenance operations, such as repair, cleaning or replacement of any of the spark plugs or plug caps.

The lid 81 is typically formed of rubber or resin, and a horizontal hinge 85 is provided between upper and lower sections 81*b* and 81*a* of the lid 81. The upper section 81*b* functions as an actual lid section 86 for openably closing the access opening 80, and this section 81*b* has a rectangular sealing member 83 fixed to its inner surface for engaging a peripheral edge of the opening 80 in a fluid-tight manner.

Further, the lid 81 has a plurality of locking projections 82 formed on an outer periphery of the inner surface thereof for engagement with the mounting holes 35*a* and 55*a* formed in the vertically-elongated substantially rectangular bearing surfaces 35 and 55. Loop-shaped seal lip 84 is also provided on the inner surface to slightly project inwardly therefrom while avoiding the plurality of locking projections 82.

The lid 81 sealingly closes the opening 80 with the locking projections 82 engaged in the mounting holes 35*a* and 55*a* and with the sealing member 83 of the actual lid section 86 engaged in the opening 80. The seal lip 84 is sealingly pressed against the outer periphery of the bearing surfaces 35 and 55 while surrounding the opening 80. Thus, the seal lip 84 seals the rear end section of the undercover 20 where the fixedly joining sections are provided.

Figure 17:
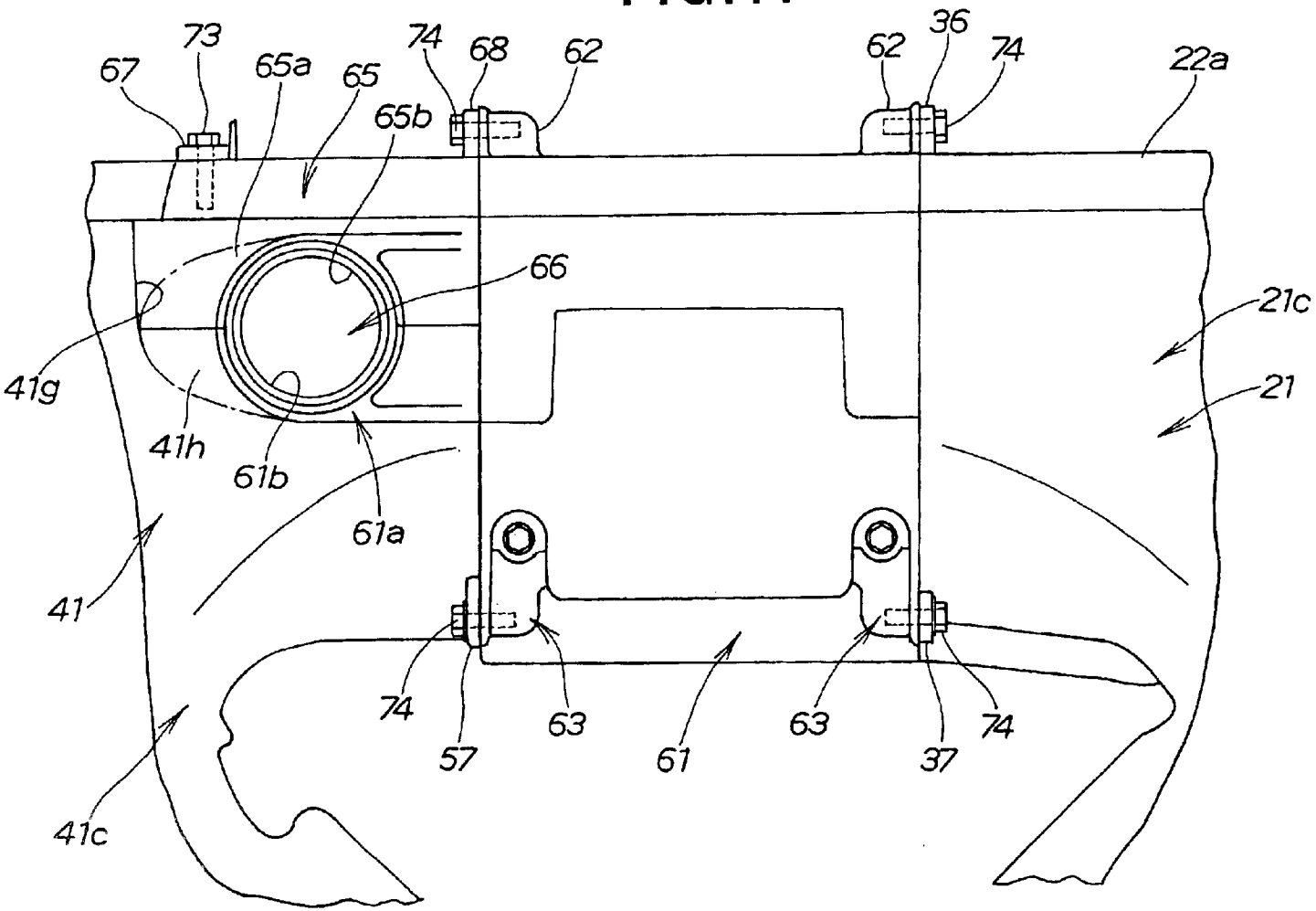
FIG. 17 is a front view showing front portions of the undercover members are integrally joined with a cable supporting bracket.

The following paragraphs describe a front cover joining structure for fixedly joining front portions of the left and right undercover members 21 and 41, with primary reference to FIGS. 3, 4 and 17. FIG. 17 is a front view showing the front portions of the cover members 21 and 41 integrally joined with the cable supporting bracket 61.

As set forth above, the separate cover 65 is fixed on the generally-L-shaped recessed upper region 41*g* of the right undercover member 41 in vertical overlapped relation thereto. As clearly seen in FIG. 4, the separate cover 65 has fixedly joining sections 68 and 67 at its upper front and rear end positions, respectively.

Further, the cable supporting bracket 61 has four fixedly joining sections 62 and 63 at its left upper and lower ends and at its right upper and lower ends.

Further, the left undercover member 21 has an upper fixedly joining section 36 located at the upper front end of the upper front end portion 21*c* and formed internally with the front end of the vertical flange 22*a*, and a lower fixedly joining section 37 located at the lower front end of the upper front end portion 21*c*, so that the left-upper and left-lower fixedly joining sections 62, 63 of the cable supporting bracket 61 are fastened with the upper and lower fixedly joining sections 36 and 37, respectively, of the left undercover member 21 by means of bolts 74 (FIG. 17) inserted in the left-and-right direction. Further, the right-upper and right-lower fixedly joining sections 62 and 63 of the cable supporting bracket 61 are fastened with the upper fixedly joining section 68 of the separate cover 65 and a lower fixedly joining section 57 of the right undercover member 41, respectively, by means of bolts 74 inserted in the left-and-right direction. The rear fixedly joining section 67 of the separate cover 65 is fastened, via a vertical bolt 73, with a not-shown fixedly joining section provided on a rear position of the recessed region 41*g* of the upper front end portion 41*c*.

In the above-described manner, the cable supporting bracket 61 and separate cover 65 are integrally secured to the front portions of the left and right undercover members 21 and 41, to thereby constitute an upper front section of the undercover 20.

Further, the cable supporting bracket 61 has an arm 61*a* projecting toward the right undercover member 41, and the arm 61*a* has a downwardly-curved cable receiving portion 61*b*.

When the cable supporting bracket 61 is mounted in place, a gutter portion is formed for supporting portions of the bundle of the throttle cable, shift cable, fuel piping, battery cable, etc. in front of the through-hole 66 defined by the recess 41*i* of the right undercover member 41 and the recess 65*b* of the separate cover 65.

Figure 18:
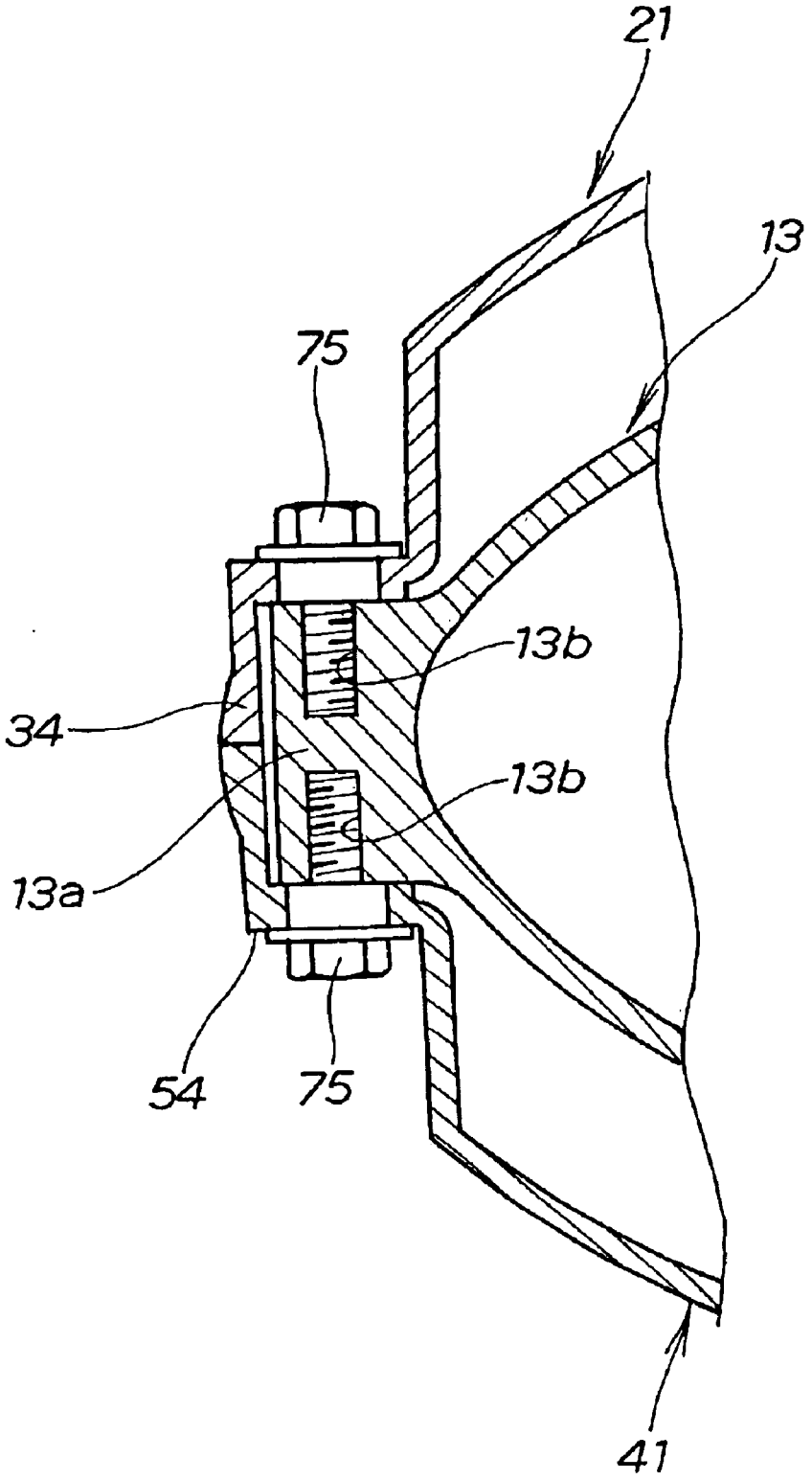
FIG. 18 is a cross-sectional top plan view showing how the left and right undercover members and an extension case are joined together.

FIG. 18 is a cross-sectional top plan view showing how the left and right undercover members 21 and 41 and the extension case 13 are joined together.

At each of the front and rear ends of the undercover 20, the respective fixedly joining sections 34 and 54 of the left and right undercover members 21 and 41 are held in edge-to-edge opposed relation to each other with an inner space left therebetween. One of mounting boss portions 13*a*, formed at the front and rear ends of the extension case 13, is positioned in the inner space, and left and right threaded holes 13*b* are formed in left and right sides of the mounting boss portions 13*a*. Horizontal bolts 75 are threadedly inserted into the respective threaded holes 13*b* from outside the fixedly joining sections 34 and 54. In this way, the bolts 75 securely fasten the front and rear ends of the left and right undercover members 21 and 41 with the front and rear ends of the extension case 13.

Figure 19:
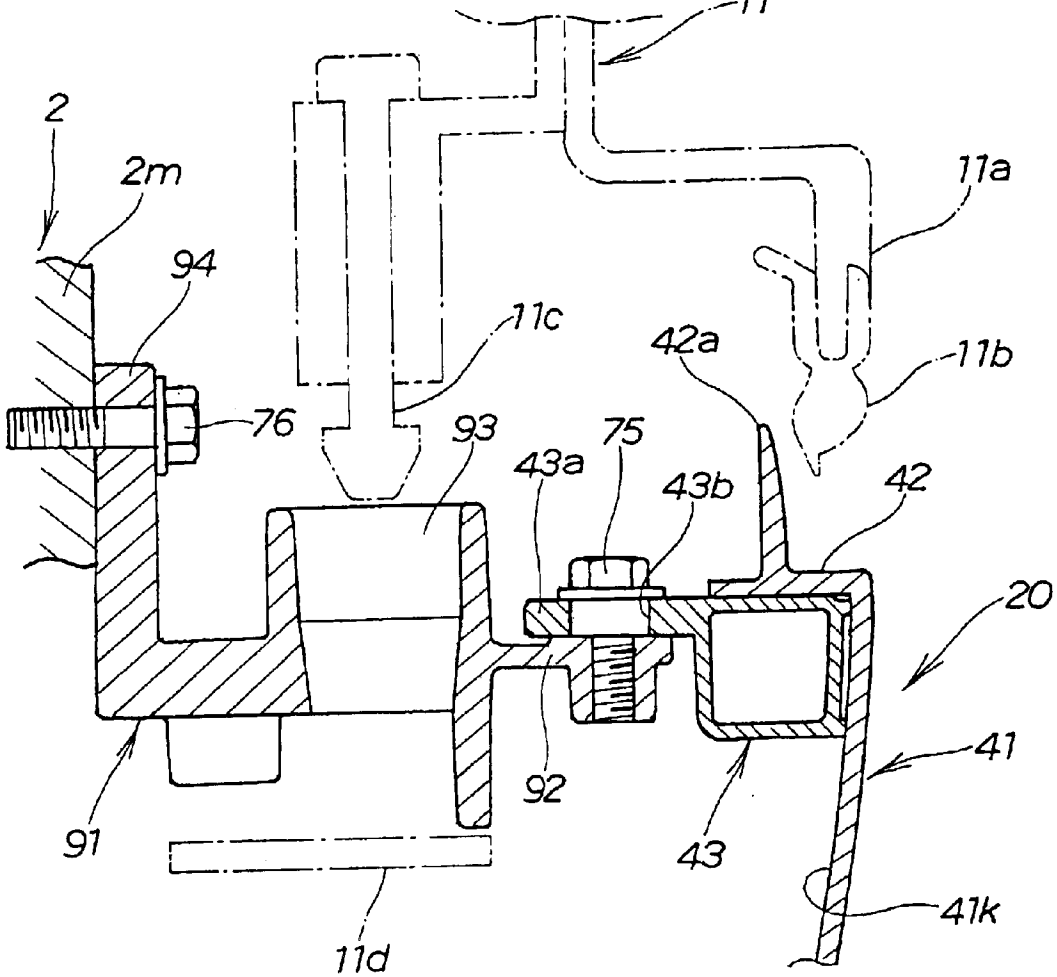
FIG. 19 is an enlarged sectional view taken along line 19—19 of FIG. 11.

FIG. 19 is an enlarged sectional view taken along line 19—19 of FIG. 11.

In the right undercover member 41, the above-mentioned upper horizontal reinforcing frame members 43 is fixed to the inner side surface 41*k* on and along the underside of the upper end horizontal flange 42, and a shelf-like supporting stay 43*a*, projecting inwardly, is integrally formed on part of the reinforcing frame members 43.

Reference numeral 91 represents a bracket formed, for example, of an aluminum alloy, and a stay 92 is formed on the outer side edge of the bracket 91. The supporting stay 43*a* and the stay 92 are securely fastened together by the vertical bolt 75.

The bracket 91 has an L-shaped upright stay 94 formed along the inner edge thereof, which is fastened with the engine 2 by a bolt 76; specifically, in the illustrated example, the L-shaped upright stay 94 of the bracket 91 is fastened with a side wall of the exhaust manifold 2*m*of the engine 2. The upper engine cover 11, indicated by dot-and-dash lines in FIG. 19, defines an upper section of the engine space 12.

Seal lip 11*b* is secured to a lower end edge 11*a* of the upper engine cover 11, and a positioning/locking striker 11*c* is secured to and extends downward from a part of the inner lower end of the upper engine cover 11. The above-mentioned bracket 91 has a positioning hole 93, and a catcher 11*d* is disposed under the positioning hole 93. The striker 11*c* is lowered through the positioning hole 93 into engagement with the catcher 11*d*, so that the upper engine cover 11 is secured to the undercover 20.

Further, as illustrated in FIG. 11, a bracket 95 is secured to a rear portion of the inner side surface of the left undercover member 21, and the bracket 95 is securely fastened via inwardly-projecting bolts 77 to a rear portion of the left side of the engine 2.

In the above-described manner, the left and right undercover members 21 and 41 have their front end portions secured to the engine 2 via the cable supporting bracket 61 and their rear end portions secured to the engine 2 via the brackets 91 and 95, so that sufficient rigidity of the entire undercover is ensured.

Figure 20:
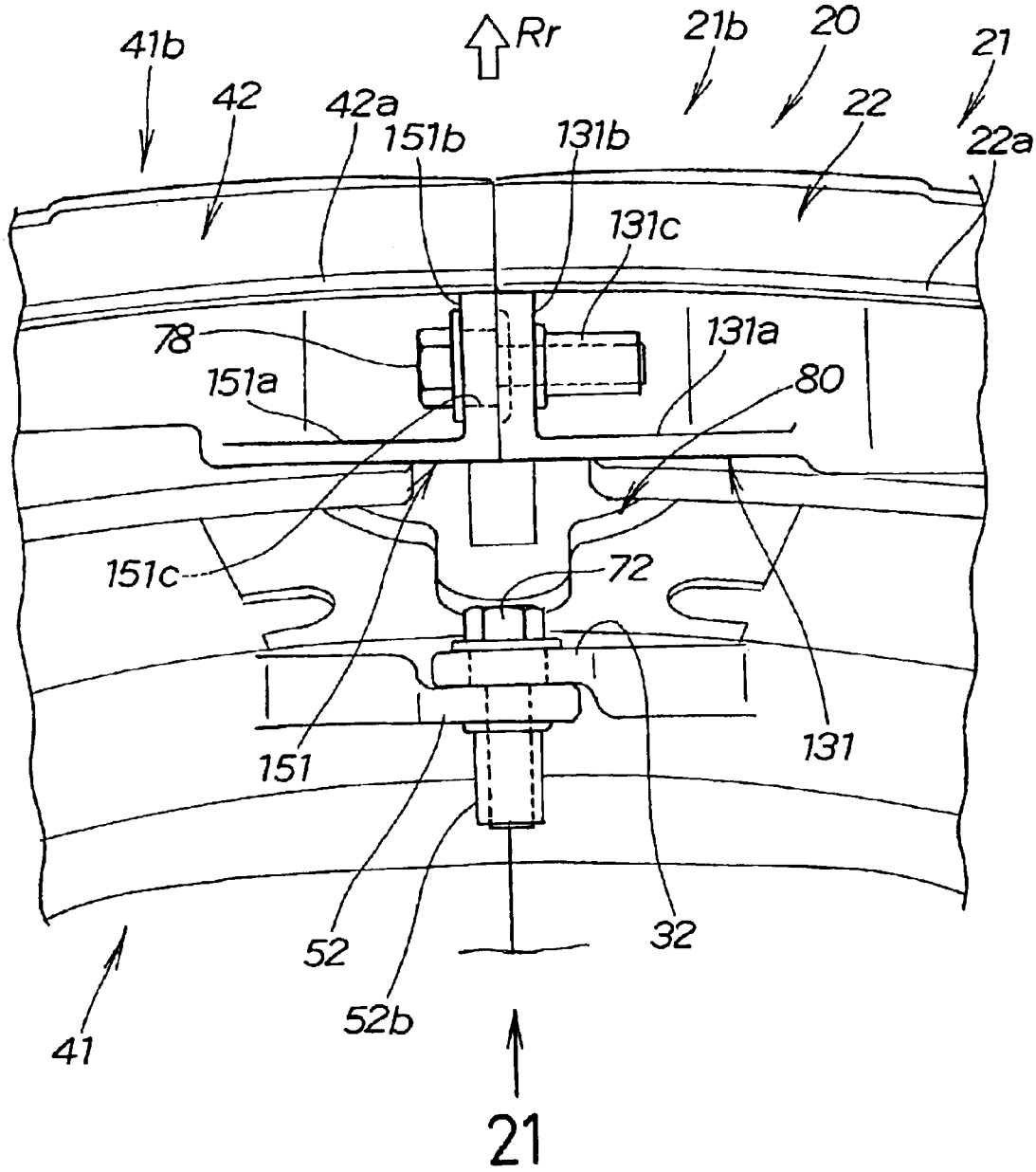
FIG. 20 is a plan view of an upper rear joining mechanism composed of the upper fixedly joining sections of the left and right undercover members.
Figure 21:
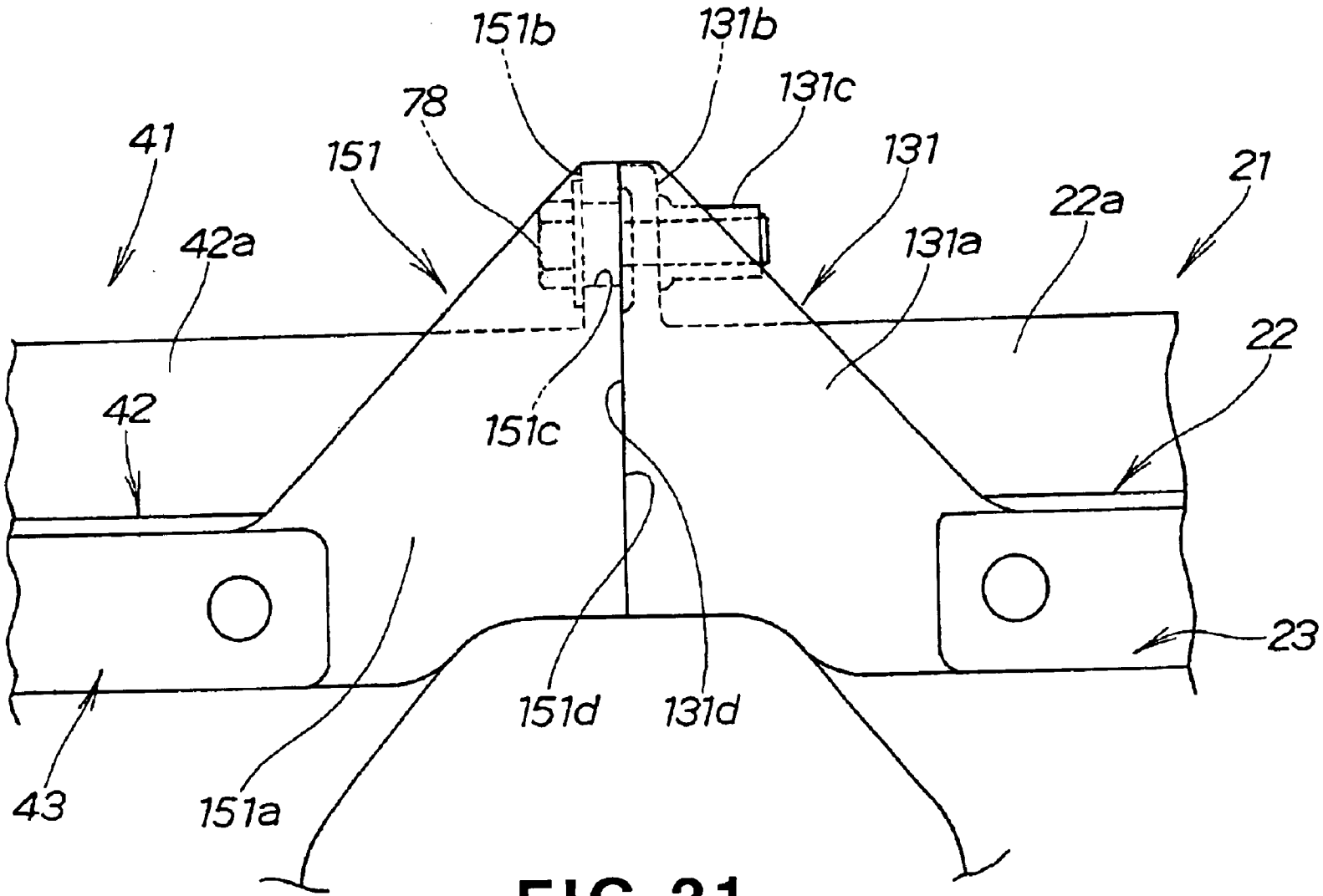
FIG. 21 is a view taken in a direction of arrow 21 of FIG. 20.

FIGS. 20 and 21 show another embodiment of the upper rear joining mechanism composed of the upper fixedly joining sections. FIG. 20 is a plan view of the upper rear joining mechanism, and FIG. 21 is a view taken in a direction of arrow 21 of FIG. 20.

In the rear end portions 21*b* and 41*b* of the left and right undercover members 21 and 41, joining flanges 131 and 151 are provided on the upper-end horizontal sealing flanges 22 and 42, respectively. The sealing flanges 22 and 42 are symmetrically-placed L-shaped plates as viewed in top plan. In the front view of FIG. 21, each of the joining flanges 131 and 151 has a substantially triangular shape having a vertical joining inner edge 131*d* or 151*d* extending upright from the corresponding horizontal sealing flange 22 or 42.

Each of the joining flanges 131 and 151 has a joining piece 131*b* or 151*b* abutted face to face against the corresponding joining inner edge 131*d* or 151*d*. Horizontal bolt 78 is threadedly inserted, through the joining piece 151*b*, mounting hole 151*c* and joining piece 131*b* , into a nut 131*c*, and thereby securely fastens together the flanges 131 and 151.

Namely, in the embodiment of FIGS. 20 and 21, the upper fixedly joining sections of the left and right undercover members 21 and 41 are joined together by means of the bolt 78 inserted in the left-and-right direction.

Note that, in the embodiment of FIGS. 20 and 21, the joining flanges 131 and 151 project beyond the upper surfaces of the corresponding sealing flanges 22 and 42. However, because the joining flanges 131 and 151 are located inside the upright pieces 22*a* and 42*a*, these flanges 131 and 151 are effectively concealed when the upper engine cover 11 is securely coupled to the undercover 20 in the above-described manner. As a result, the embodiment can accomplish a superior outer appearance of the covering assembly by preventing exposure of the fixedly joining sections while employing the cover joining structure with the bolt inserted in the left-and-right direction.

Figure 22:
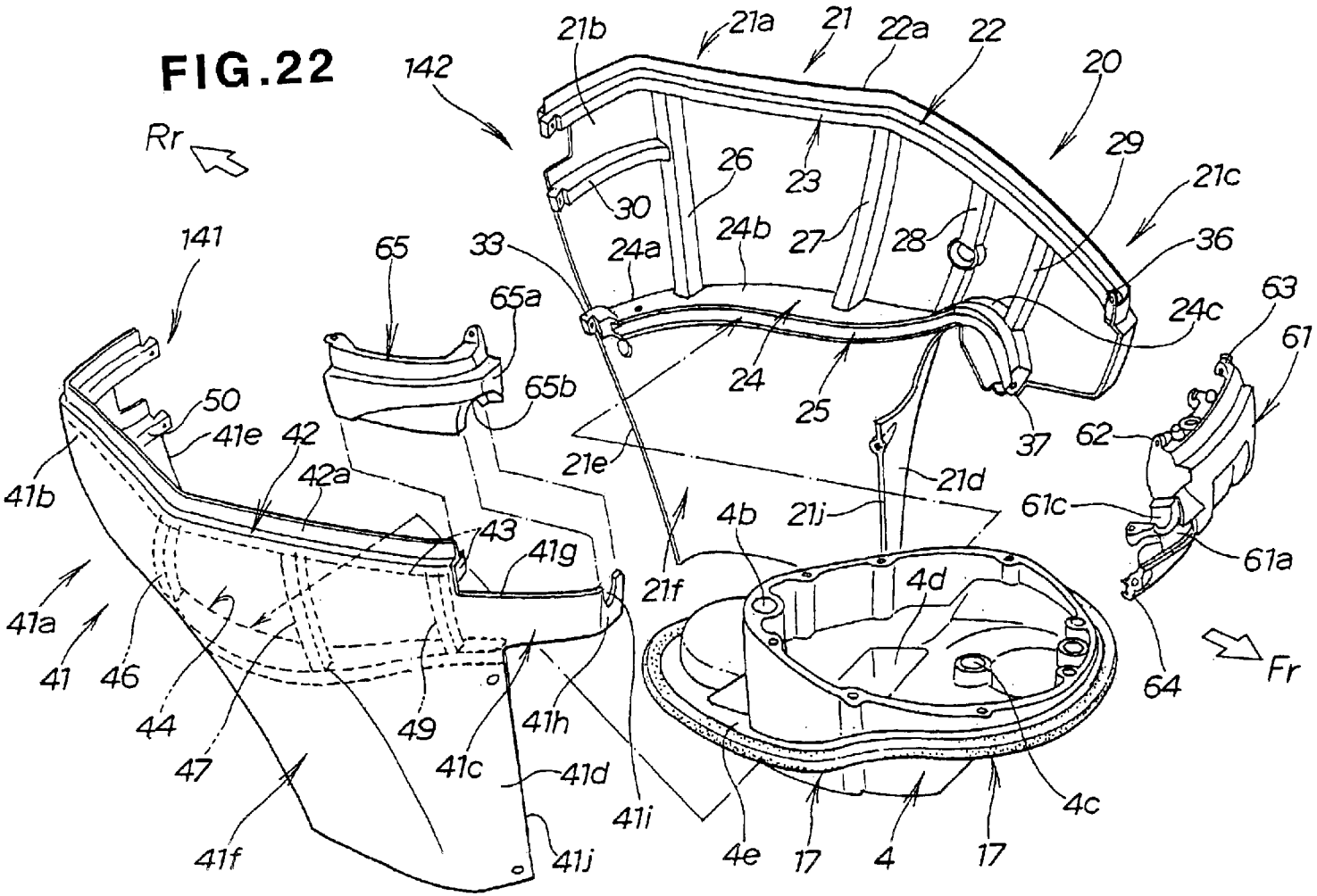
FIG. 22 is an exploded perspective view showing the left undercover member, right undercover member and mount case, which is similar to FIG. 3 but shows a second embodiment of the rear cover joining structure.

FIG. 22 shows a second embodiment of the rear cover joining structure employed in the outboard engine unit 1 of the present invention. In FIG. 22, the same elements as in FIG. 3 are represented by the same reference numerals and will not be described here to avoid unnecessary duplication. Primarily, features different from the above-described will be described below with reference to FIGS. 22 to 27.

Figure 23:
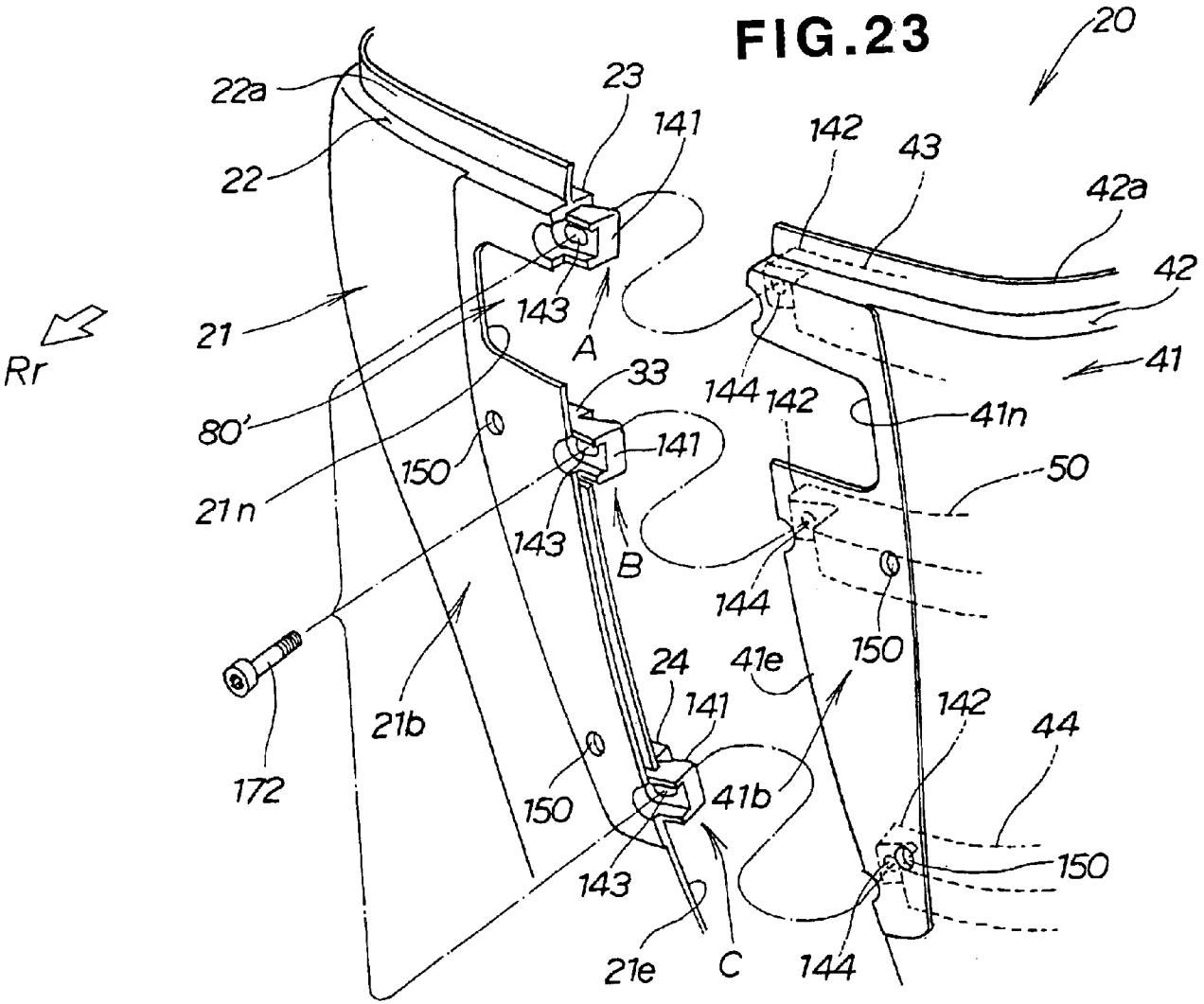
FIG. 23 is an exploded perspective view showing a principal section of the rear cover joining structure of FIG. 22.

FIG. 23 is an exploded perspective view showing a principal section of the second embodiment of the rear cover joining structure.

As shown, each of the left and right undercover members 21 and 41 of the undercover 20 has the horizontal flange 22 or 42 abutted, via the sealing member, against the lower end edge of the upper engine cover 11, and the vertical flange 22*a* or 42*a* extending upright from the horizontal flange 22 or 42.

Further, the right undercover member 41 has spaced-apart fixedly joining sections 142 on its rear vertical edge 41*e*, while the left undercover member 21 has spaced-apart fixedly joining sections 141, corresponding in shape and position to the fixedly joining sections 142, on its rear vertical edge 21*e* opposed to the rear vertical edge 41*ea* of the right undercover member 41.

The fixedly joining sections 142 of the right undercover member 41 are provided at the respective distal ends of the upper and lower horizontal reinforcing frame members 43 and 44 and intermediate subsidiary horizontal reinforcing frame member 50, while the fixedly joining sections 141 of the left undercover member 21 are provided at the respective distal ends of the upper and lower horizontal reinforcing frame members 23 and 24 and intermediate subsidiary horizontal reinforcing frame member 30. The fixedly joining sections 141 and the fixedly joining sections 142 project toward each other by a predetermined length.

Each of the fixedly joining sections 142 and 141 has a suitable dimension in the front-and-rear direction of the outboard engine unit 1 (i.e., thickness) that is equal to or less than about half of the thickness of the corresponding reinforcing frame member. As the rear vertical edge 41*e* of the right undercover member 41 and the rear vertical joining edges 21*e* of the left undercover member 21 are abutted against and joined to each other, the fixedly joining sections 142 and the fixedly joining sections 141 are overlapped face to face in the front-and-rear direction, to thereby provide upper, intermediate and lower jointed sections as denoted at A, B and C in FIG. 23.

In FIG. 23, three bolts 172, inserted in the front-and-rear direction, fasten together corresponding pairs of the fixedly joining sections 141 and 142 of the cover members 21 and 41 in the front-and-rear direction, and mounting holes 150 are formed for attachment of a lid 81A openably closing a maintenance access opening 80'.

Figure 24:
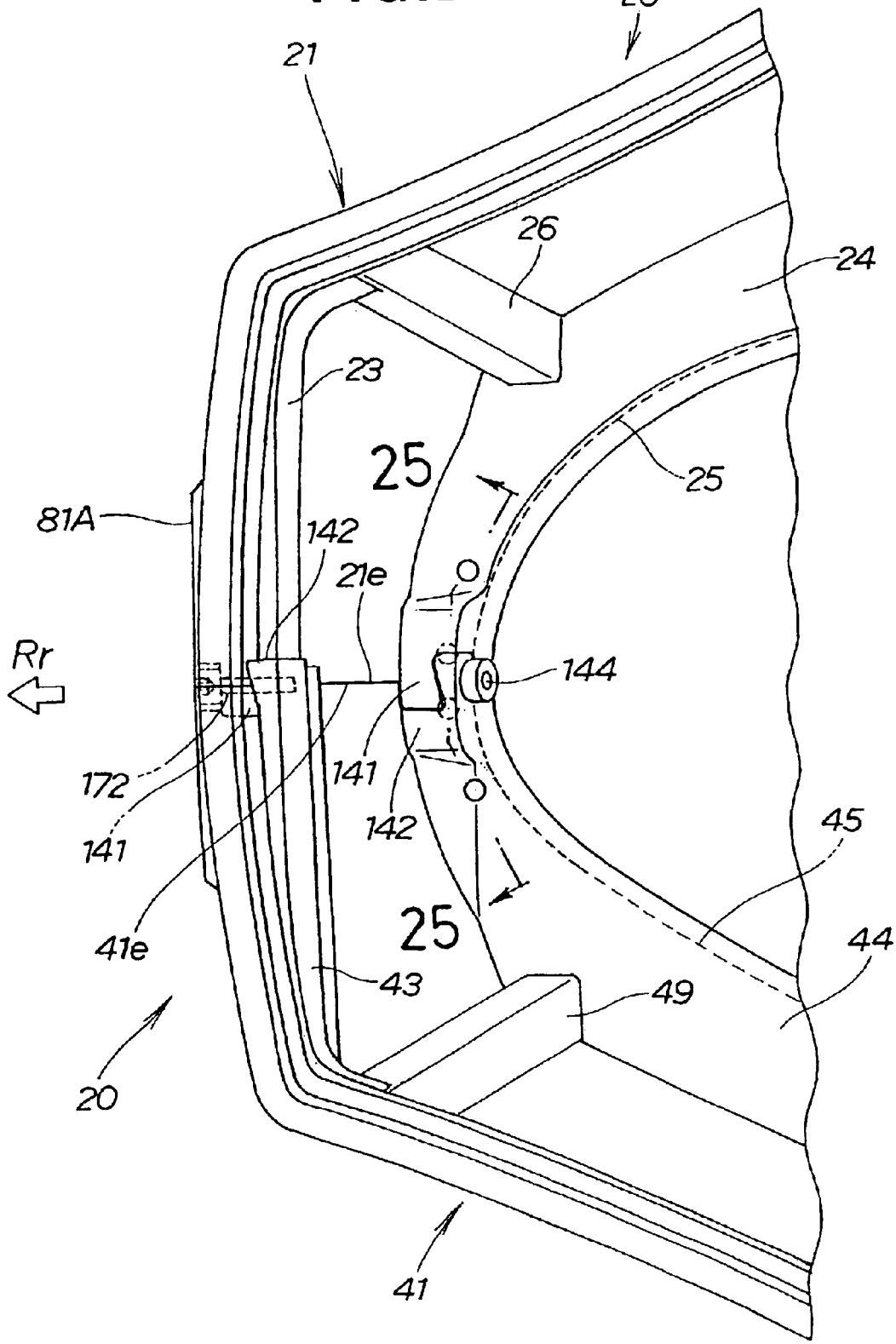
FIG. 24 is a top plan view of the undercover having the left and right undercover members joined to each other via the rear cover joining structure of FIG. 23.
Figure 25:
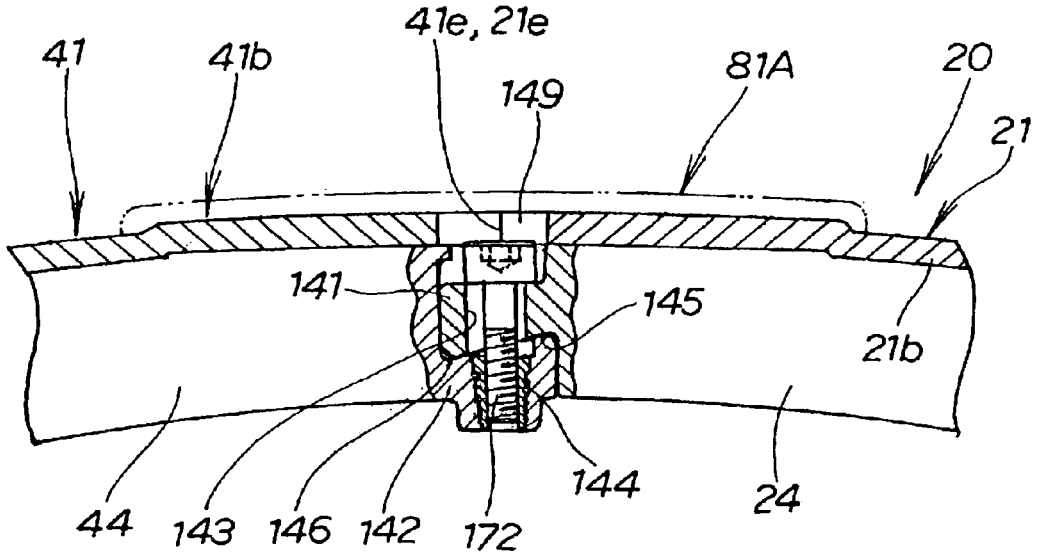
FIG. 25 is an enlarged sectional view of the undercover taken along line 25—25 of FIG. 24.

FIG. 24 is a top plan view of the undercover 20 having the left and right undercover members 21 and 41 joined to each other in the above-described manner, with the mount case and other cases removed for clarity. FIG. 25 is an enlarged sectional view of the undercover 20 taken alone the 25—25 line of FIG. 24, and FIG. 26 is an exploded sectional view of the undercover 20 shown in FIG. 25.

Figure 26:
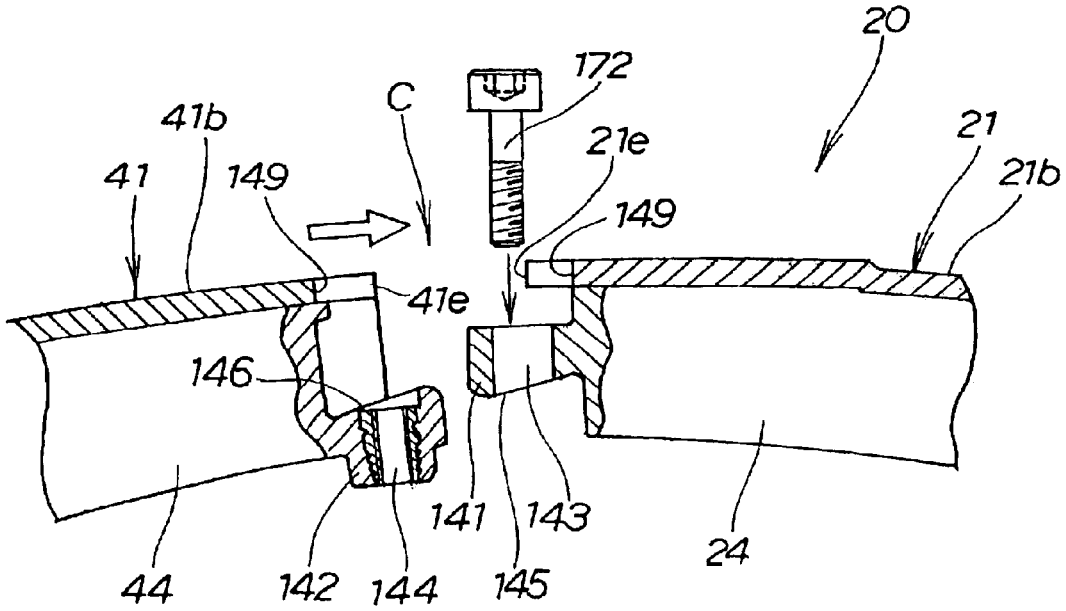
FIG. 26 is an exploded sectional view of the undercover shown in FIG. 25.

As illustrated in FIG. 26, semicircular recesses 149, horizontally symmetrical to each other, are formed in the rear vertical edges 41*e* and 21*e* of the right and left undercover members 41 and 21 immediately above the fixedly joining sections 142 and 141 so that these recesses 149 together form a circular through-hole when the right and left undercover members 41 and 21 are joined together along their respective rear vertical edges 41*e* and 21*e*. The fixedly joining sections, projecting from the distal ends of the corresponding lower reinforcing frame members 44 and 24 toward each other, are overlapped in the front-and-rear direction right in front of the recesses 149.

Each of the fixedly joining sections on one of the undercover members (cover member 21 in the illustrated example) has a through-hole 143 elongated in the left-and-right direction, while each of the fixedly joining sections on the other undercover member (cover member 41 in the illustrated example) has a though-hole with a nut 144 embedded therein.

Each of the fixedly joining sections 141 has a front surface 145 slanted forwardly from its proximal end to its distal end such that the distal end of the front surface 145 is located forwardly of the proximal end. Further, each of the fixedly joining sections 142 has a rear surface 146 slanted rearwardly from its proximal end to its distal end so as to correspond to the slanted front surface 145 of one of the mating fixedly joining sections 141; that is, the rear surface 146 is slanted such that the distal end of the rear surface 146 is located rearwardly of the proximal end. Absolute values of the slanted angles of the surface 145 and rear surface 146 are substantially identical to each other.

The right and left undercover members 41 and 21 are joined together with their respective rear vertical edges 21*e* and 41*e* abutted against each other and with the fixedly joining sections overlapped face to face, in the front-and-rear direction, along their slanted surfaces 146 and 145. The bolt 172 is loosely inserted through the elongated hole 143 of the fixedly joining section 141 into the mating fixedly joining section 142, located forwardly of the fixedly joining section 141, where the bolt 172 is screwed into the nut 144.

Because the fixedly joining sections 141 and 142 are overlapped along their respective slanted surfaces 145 and 146, the sections 141 and 142 can be laterally brought closer to full overlap therebetween (i.e., into a greater degree of overlap therebetween) and pressed against each other more tightly, through "wedge-like" action, as the bolt 172 is tightened against the nut 144. The elongated hole 143 of the one fixedly joining section 141 allows the portions 141 and 142 to be readily brought into a greater degree of overlap. FIG. 25 shows the right and left undercover members 41 and 21 joined together with the fixedly joining sections 142 and 141 secured in overlapped relation via the bolt 172. In FIG. 25, the lid 81A, denoted by a phantom line, openably closes the maintenance access opening 80'.

Figure 27:
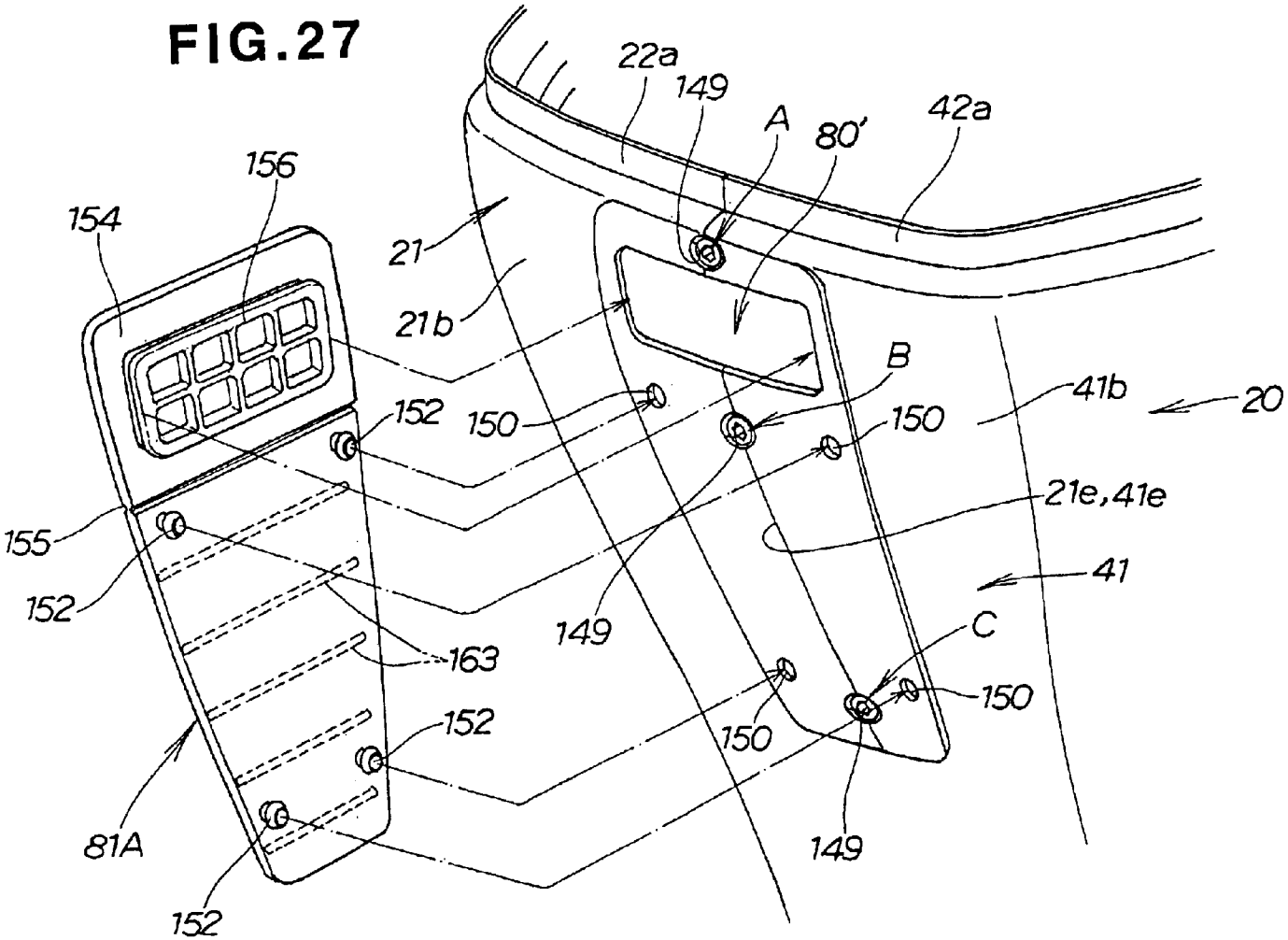
FIG. 27 is a perspective view showing a rear end section of the undercover formed by joining together the right and left undercover members.
Figure 28:
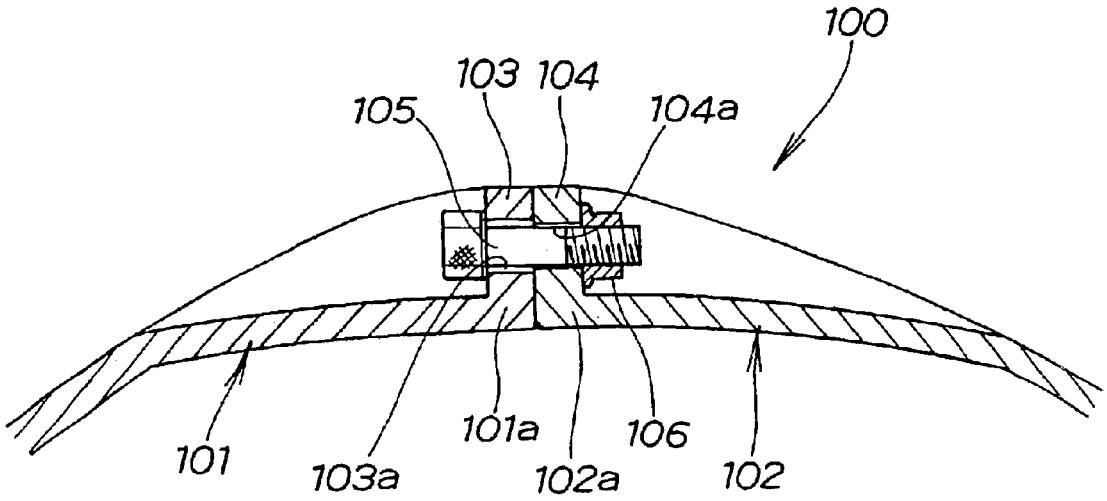
FIG.28 (PRIOR ART)
FIG. 28 is an enlarged cross-sectional top plan view showing an example of a conventional structure for joining together left and right members of an undercover in an outboard engine unit.

FIG. 27 is a perspective view showing a rear end section of the undercover 20 formed by joining together the right and left undercover members 41 and 21.

The maintenance access opening 80' is formed, in an upper rear end of the undercover 20, to permit access to any of the spark plugs positioned centrally in the individual combustion chambers. The three jointed sections A, B and C are provided on the rear vertical edges 41*e* and 21*e*, in vertically spaced-apart relation to each other. The lid 81A made of rubber or synthetic resin has a plurality of protrusions 152 provided on the inner surface thereof, and the lid 81A closes the maintenance access opening 80' with the protrusions 152 fitted in the mounting holes 150.

The lid 81A also has a plurality of reinforcing ribs 163 on its outer surface, and an upper end portion 154 hinged at 155 for rearward pivotal movement. Lattice-shaped reinforcing rib 163 is formed on the inner surface of the lid 81A. Thus, the lid 81A, attached to the undercover 20 to close the maintenance access opening 80', allows the opening 80' to be exposed by the upper end portion 154 being caused to pivot rearwardly downward. In this way, maintenance can be performed on various components and areas around the cylinder head of the engine, etc.

In each of the above-described embodiments, each of the fixedly joining sections is provided on a portion of the corresponding frame member which is located within the engine space as viewed from above (in a top plan view) and located above the horizontal connection between, i.e., the mutually-joined surfaces of, the upper cover and the undercover as viewed sideways (in a side view). Thus, the bolt can be easily and reliably inserted to fasten together the fixedly joining sections on the opposed frame members. Also, the thus fastened-together joining sections can be effectively concealed by the mutually-joined surfaces of the upper and undercovers, with no noticeable projection and/or depressed surface, associated with the bolting, exposed on the outer wall sections of the cover members. As a result, the present invention can not only accomplish a superior outer appearance, but also facilitates the joining operation because the fixedly joining sections are located above the mutually-joined surfaces of the upper and undercovers.

It should be appreciated that the cover members to be joined together in accordance with the basic principles of the present invention are not limited to the port-side and starboard-side cover members of the undercover (lower engine cover) 20. For example, the present invention may be applied to other cases where the upper engine cover or the like comprises left and right cover members, to join together the left and right cover members of the upper engine cover or the like.

Further, the present invention may be applied to other cases where the undercover comprises upper and undercover members and at least one of the upper and undercover members comprises left and right cover elements, to join together the left and right cover elements. Furthermore, whereas the preferred embodiment has been described above as applied to join together the rear ends of the left and right cover members, it may also be applied to join together the front ends of the cover members.

In summary, the present invention arranged in the above-described manner can afford a variety of advantageous benefits as set forth below.

Namely, the present invention is characterized in that the fixedly joining sections are provided on respective ones of the opposed joining edges of the left and right cover members, the opposed joining edges of the left and right cover members are abutted against each other with the fixedly joining sections of the left and right cover members overlapped in face-to-face relation with each other in the front-and-rear direction of the outboard engine unit and the fixedly joining sections of the left and right cover members are fastened together by means of the fastener, such as a bolt, in the front-and-rear direction. Because the fastening by the fastener is in the front-and-rear direction of the outboard engine unit, the present invention can eliminate needs for the fastener to be inserted in the left-and-right direction of the outboard engine unit and for any noticeable projecting and/or depressed surface to be formed in the left-and-right direction for receiving the faster as in the prior art outboard engine units. Therefore, it is possible to prevent any noticeable projecting and/or depressed surface from being formed around the fastener fastening together the left and right cover members that have gently-curved surfaces. Consequently, the present invention can minimize a degree of projection and/or depression (surface uneveness) around the fastener, and thereby allows the joint between the left and right cover members to have a neat, smooth, continuous surface. As a result, the present invention achieves a significantly improved overall outer appearance of the outboard engine unit. Because no noticeable projecting and/or depressed surface is formed on the opposed joining edges of the left and right cover members, the present invention can provide a simplified joining construction of the opposed joining edges of the left and right cover members and hence simplified joint between the left and right cover members of the outboard engine unit.

Further, with the arrangement that the fixedly joining sections are provided on the respective frame members reinforcing the outer wall sections of the left and right cover members, the present invention can secure sufficient rigidity of the outer wall sections of the cover members. Also, because the fixedly joining sections are provided on such rigid frame members, the separate left and right undercover members can be joined together with high joining rigidity.

Furthermore, because the frame members enhance the rigidity of the corresponding outer wall sections, the present invention can eliminate the sink mark problem of the conventional covering arrangement where reinforcing ribs are formed integrally on the cover members, thereby achieving a superior appearance of the covering arrangement of the outboard engine unit. Further, with the arrangement that the separate cover members are integrally joined together through the fixedly joining sections provided on the frame members, the outer wall sections of the cover members can be formed with ease into desired construction and shapes, so that the joining edges of the left and right cover members can be joined with an optimal construction and shape without suffering from sink mark problems during molding.

The present disclosure relates to the subject matters of Japanese Patent Applications No. 2002-209643 and No. 2002-210059, both filed Jul. 18, 2002, the disclosures of which are expressly incorporated herein by reference in their entireties.

What is claimed is:

1. A cover joining structure in an outboard engine unit, the outboard engine unit including an engine; a propeller drivable by the engine; a drive shaft for transmitting a driving force from the engine to the propeller; a casing assembly supporting thereon the engine and rotatably supporting and accommodating therein the drive shaft, the outboard engine unit being attached via the casing assembly to a body of a boat during use of the outboard engine unit for tilting and steering movement; and a covering assembly defining at least part of an engine space for accommodating therein the engine, the covering assembly including separate left and right cover members; the cover joining structure comprising:

fixedly joining sections provided on respective ones of opposed joining edges of the left and right cover members, the opposed joining edges of the left and right cover members being abutted against each other with the fixedly joining sections of the left and right cover members overlapped in face-to-face relation with each other in a front-and-rear direction of the outboard engine unit; and fastening means for fastening together the fixedly joining sections, overlapped in face-to-face relation, in the front-and-rear direction, to thereby join together the left and right cover members.

2. A cover joining structure in an outboard engine unit as claimed in claim 1; wherein the left and right cover members comprise port-side and starboard-side undercover members of an undercover of the covering assembly detachably attached with respect to the body of tbe boat, and wherein the opposed joining edges of the port-side and starboard-side undercover members are abutted against each other, with the fixedly joining sections provided on respective ones of opposed joining edges of the port-side and starboard-side undercover members overlapped in the front-and-rear direction of the outboard engine unit, and fastened together in the front-and-rear direction.

3. A cover joining structure in an outboard engine unit as claimed in claim 1; wherein the fixedly joining section provided on one of the left and right cover members has a surface slanted from it proximal end toward its distal end in one of forward and rearward directions while the fixedly joining section provided on the other of the left and right cover members has a surface slanted from its proximal end toward its distal end in other of the forward and rearward directions, and the fixedly joining sections of the left and right cover members are overlapped with each other in the front-and-rear direction along the slanted surfaces, and wherein the fixedly joining section provided on the one of the left and right cover members has an elongated hole extending therethrough in the front-and-rear direction and elongated in a left-and-right direction of the outboard engine unit, the fastening means being loosely inserted through the elongated hole and then threadedly engaged at its distal end portion in a threaded hole formed in the fixedly joining section provided on the other of the left and right cover members.

4. A cover joining structure in an outboard engine unit as claimed in claim 1; wherein the cover assembly further comprises an upper cover member, the left and right cover members comprise left and right undercover members, respectively, and the cover joining structure further comprises frame members integrally secured to respective inner side surfaces of resin-made outer wall sections of the left and right undercover members, and the fixedly joining sections are provided on respective ones of the frame members of the left and right undercover members for joining together the outer wall sections of the left and right undercover members.

5. A cover joining structure in an outboard engine unit as claimed in claim 4; wherein each of the frame members is made of resin.

6. A cover joining structure in an outboard engine unit as claimed in claim 4; further comprising a bolt inserted through the fixedly joining sections, provided on the frame members of the left and right undercover members, in a front-and-rear direction of the outboard engine unit, to thereby join together the left and right undercover members.

7. A cover joining structure in an outboard engine unit as claimed in claim 4; further comprising a bolt inserted through said the fixedly joining sections, provided on the frame members of the left and right undercover members, in a vertical direction of the outboard engine unit, to thereby join together the left and right undercover members.

8. A cover joining structure in an outboard engine unit as claimed in claim 4; further comprising a bolt inserted through said the left and right undercover members, in a left-and-right direction of the outboard engine unit, to thereby join together the left and right undercover members.

9. A cover joining structure in an outboard engine unit as claimed in claim 4; wherein each of the fixedly joining sections is provided on a portion of the frame member which is located within the engine space as viewed from above and located above mutually-joined surfaces of the upper cover and the undercover as viewed sideways.

* * * * *